US011835329B2

(12) United States Patent
Oliver et al.

(10) Patent No.: US 11,835,329 B2
(45) Date of Patent: Dec. 5, 2023

(54) MINING VEHICLE

(71) Applicant: Olitek Pty Ltd, Northgate (AU)

(72) Inventors: James Thomas Oliver, Northgate (AU); Anthony James Sprague, Melbourne (AU)

(73) Assignee: Olitek Pty Ltd, Northgate (AU)

( * ) Notice: Subject to any disclaimer, the term of this patent is extended or adjusted under 35 U.S.C. 154(b) by 0 days.

(21) Appl. No.: 17/982,073

(22) Filed: Nov. 7, 2022

(65) Prior Publication Data

US 2023/0204335 A1 Jun. 29, 2023

Related U.S. Application Data

(63) Continuation of application No. 17/256,254, filed as application No. PCT/AU2019/050689 on Jun. 28, 2019, now abandoned.

(30) Foreign Application Priority Data

Jun. 29, 2018 (AU) ..... 2018902374

(51) Int. Cl.
*F42D 1/22* (2006.01)
*E21C 37/00* (2006.01)
*E21C 41/30* (2006.01)

(52) U.S. Cl.
CPC ..... *F42D 1/22* (2013.01); *E21C 37/00* (2013.01); *E21C 41/30* (2013.01)

(58) Field of Classification Search
CPC ..... F42D 1/08; F42D 1/22; E21C 37/00
USPC ..... 102/313
See application file for complete search history.

(56) References Cited

U.S. PATENT DOCUMENTS

| | | | | |
|---|---|---|---|---|
| 3,104,584 | A | 9/1963 | Jacobs | |
| 5,308,149 | A | 5/1994 | Watson | |
| 11,680,782 | B2 * | 6/2023 | Averett | F42D 3/04 102/313 |
| 2015/0176371 | A1 | 6/2015 | Diaj | |
| 2017/0356292 | A1 | 12/2017 | Wang et al. | |
| 2018/0106584 | A1 | 4/2018 | Santos et al. | |

(Continued)

FOREIGN PATENT DOCUMENTS

| | | |
|---|---|---|
| CA | 2225087 | 3/1998 |
| CN | 107388910 | 11/2017 |
| GB | 2260752 A | 12/1992 |

(Continued)

OTHER PUBLICATIONS

Australian International Search Report pertaining to PCT/AU2019/050689, filed Jun. 28, 2019, 9 pages.

*Primary Examiner* — Bret Hayes
(74) *Attorney, Agent, or Firm* — DINSMORE & SHOHL LLP

(57) ABSTRACT

An explosives delivery vehicle for delivering a booster for initiating an explosion of an explosive material in a hole in a floor of a mine pit to an operative depth in the hole. The vehicle comprises a storage assembly for storing a plurality of the boosters, a booster loading assembly for (i) supporting the booster in a delivery position above the hole and (ii) moving the booster downwardly into the hole and inserting the booster at an operative depth in the hole; and a delivery assembly for transporting the booster from the storage assembly to the loading assembly.

20 Claims, 24 Drawing Sheets

(56) References Cited

U.S. PATENT DOCUMENTS

2018/0184575 A1 7/2018 Oliver

FOREIGN PATENT DOCUMENTS

| | | | |
|---|---|---|---|
| WO | 03/042626 | A1 | 5/2003 |
| WO | 2006/045144 | A1 | 5/2006 |
| WO | 2011/106830 | A1 | 9/2011 |
| WO | 2017/147657 | A1 | 9/2017 |
| WO | 2017/181207 | A1 | 10/2017 |

* cited by examiner

MINING VEHICLE

CROSS-REFERENCES TO RELATED APPLICATIONS

This application is a continuation of U.S. patent application Ser. No. 17/256,254, filed Dec. 28, 2020, as a national-stage application under 35 U.S.C. § 371 of International Application No. PCT/AU2019/050689, filed Jun. 28, 2019, which claims benefit of priority to Australian Patent Application No. 2018902374, filed Jun. 29, 2018.

TECHNICAL FIELD

The invention relates to a mining vehicle for delivering a detonation device for initiating an explosion of an explosives material into a hole in a floor of a mine.

The invention also relates to a method of using the mining vehicle within a mine for the purpose described in the preceding paragraph.

BACKGROUND

The drill and blast process used on many mining sites involves a number of operations that are carried out by mine personnel on a pit floor.

There are safety risks for the mine personnel when on a pit floor. The safety risks are compounded when mining operations are carried out in extreme conditions, such as in mines located in very hot and in very cold regions. The safety risks are also compounded when mining in and around pits where there is geothermal activity and the surface of the pit floor is hot and unstable and the pit temperature increases with depth. When mining in these pits, by way of example there can be unpredictable geysers in drilled holes, with hot water/steam being projected upwardly.

One of the operations in a drill and blast process involves locating detonation devices into blast holes in the pit floor. The detonation devices typically contain a small charge of explosive material. The purpose of the detonation devices is to initiate an explosion of explosives material, such as a bulk explosives material, in the blast hole. Each detonation device is hereinafter referred to as a "booster".

More specifically, the term "booster" as used herein is understood to refer to a detonation device typically containing a small charge of explosive material that can be located in a blast hole for the purpose of initiating an explosion of an explosive, such as a bulk explosives material, in the blast hole. In a situation where the booster contains an explosive material, the explosive material may be a charge of liquid or solid explosive of a fixed quantity that is calculated to detonate a fixed volume of explosive emulsion (or other suitable form of explosive formulation) within a primed hole in the pit floor.

The present invention is concerned with minimising the safety risks associated with locating boosters in blast holes in a pit floor.

The above description is not an admission of the common general knowledge in Australia and elsewhere.

Unless defined otherwise, all technical and scientific terms used herein have the same meaning as commonly understood by one of ordinary skill in the art to which this invention belongs. Although any methods, vehicles and other equipment and devices, and materials similar or equivalent to those described herein can also be used in the practice or testing of the present invention, a limited number of the exemplary methods, vehicles and other equipment and devices, and materials are described herein.

SUMMARY OF THE INVENTION

In broad terms, the invention provides an explosives delivery vehicle for delivering a booster for initiating an explosion of an explosives material in a hole in a floor of a pit to an operative depth in the hole, the vehicle comprising:

(a) a storage assembly for storing a plurality of the boosters;

(b) a booster loading assembly for (i) supporting the booster in a delivery position above the hole and (ii) moving the booster downwardly into the hole and inserting the booster at an operative depth in the hole; and (c) a delivery assembly for transporting the booster from the storage assembly to the loading assembly.

The vehicle makes it possible to insert boosters into holes without an operator having to stand on the floor of the pit. The vehicle has other advantages that are described below.

The loading assembly may comprise a pusher element for applying a downwardly-acting force to move the booster into the hole to the operative depth.

The downwardly acting force may be a downward force applied via the pusher element to the booster to drive the booster into the hole.

The downwardly acting force may be a consequence of the weight of the pusher element and the booster. In other words, the downwardly acting force may be a gravitational force pulling the booster into the hole to the operative depth.

The booster and the pusher element may have complementary formations that allow the booster to receive and locate the pusher element.

The complementary formations may allow the pusher element to be releasably coupled to the booster.

The complementary formations may allow the pusher element to be positively docked with the booster.

The complementary formations may include a recess in an upper end of the booster that can receive the pusher element.

The pusher element may be formed to (a) couple the booster and the pusher element together to support the booster while the pusher element, in use, moves the booster downwardly into the hole to the operative depth in the hole and (b) release the booster from the pusher element when the booster is at the operative depth so that the pusher element can be withdrawn from the hole.

The delivery assembly may be any suitable assembly for transporting the booster from the storage assembly to the loading assembly.

For example, the delivery assembly may comprise an arm that is moveable to transport the booster from the storage assembly to the loading assembly.

The arm may comprise a retaining member, for example in the form of grippers, that can engage and retain the booster while the arm, in use, transports the booster from the booster storage assembly to the booster delivery position and can release the booster when the booster is at the booster delivery position.

The arm may be pivotally mounted for movement about a vertical axis for transporting the booster from the storage assembly to the loading assembly.

The booster may be part of a booster assembly, with the booster assembly comprising in co-axial alignment:

(a) the booster;

(b) a spool and a detonation cord wrapped around the spool in a storage position outside the hole and connected to the spool and to the booster, with the spool being provided for allowing the detonation cord to be unwound from the spool as the booster is moved from the storage position to the operative depth in the hole and the spool remains in the storage position; and (c) a stake for locating the spool in the pit floor proximate the hole after the booster is at the operative depth in the hole.

An end of the spool may be formed to receive and locate an end of the booster such that the booster is seated on the spool when the booster assembly is in an upright orientation in the storage position before moving the booster to the operative depth in the hole.

The booster and the spool may have complementary formations that allow the spool to receive and locate the booster and thereby seat the booster on the spool.

The booster may be seated on the spool by being releasably coupled to the spool so that, in use, the booster is coupled to the spool in the storage position and can be moved clear of the spool as part of a process for moving the booster to the operative depth in the hole.

The booster and the spool may have complementary formations that allow the booster and the spool to be releasably coupled together by positively docking the booster on the spool and allow the booster to be released from the positive docking and moved clear of the spool as part of the process for moving the booster to the operative depth in the hole. With this arrangement, in use, the booster, spool and stake of the booster assembly may be moved together as a unit from the storage position to a position proximate the hole.

The storage assembly may be adapted to store a plurality of the booster assemblies.

The booster may comprise a booster casing that contains the explosives charge.

The booster casing may have an engagement feature, such as a collar, that facilitates engagement of the booster with the arm of the delivery assembly.

The spool may have a brake to control the release of the detonation cord.

The spool may comprise a spool casing having an engagement feature, such as a collar, that facilitates engagement of the booster assembly with the arm of the delivery assembly. With this arrangement, in use, the delivery assembly can move the booster assembly from the booster storage assembly to the loading assembly.

The stake may be connected to the spool so that the spool and the stake are movable as a unit.

The spool and the stake may be separately formed as two components that are connected together.

The spool and the stake may be connected together so that the spool can rotate about a central axis of the stake.

The spool may include a central cavity extending axially upwardly from a lower end of the spool that receives the stake.

The stake may include an elongate shank that is received in the cavity of the spool and supported for rotation about a central axis of the shank.

The storage assembly may comprise a plurality of upwardly-extending storage tubes for receiving and retaining the booster or booster assembly, with one booster or booster assembly per tube.

The storage assembly may comprise a lifting assembly for lifting each booster or booster assembly upwardly to an extended position such that the booster extends at least partially from the tube, Each storage tube may include an internal guide that can slide in the tube and is adapted to receive and support a lower end of the booster assembly in the tube.

The internal guide may be adapted to receive and support a lower end of the stake of the booster assembly in the tube.

The internal guide may include an outer surface that has a diameter that is marginally less than a diameter of an internal wall of the tube and, in use, contacts the inner wall and facilitates sliding movement of the guide in the tube.

The internal guide may include a pair of spaced apart collars that have the above-described outer surfaces that, in use, contact the inner wall and facilitate sliding movement of the guide in the tube.

The spacing between the collars may be selected so that the guide can move in a stable way within the tube.

The internal guide may include a cavity extending from an upper wall of the guide for releasably receiving and supporting the stake. With this arrangement, the stake can be lifted clear of the internal guide when the booster assembly has been lifted to a raised position in the tube.

The storage assembly may comprise a platform that is arranged to rotate about a central upright axis, with the platform supporting the tubes. Rotation of the platform moves the tubes (and the boosters in the tubes) into a loading position. The tubes are open-ended, with the lower ends aligned with openings in the platform.

The invention also provides a booster assembly for use in a drill and blast operation, with the booster assembly comprising in co-axial alignment:

(a) a booster for initiating an explosion of an explosives material in a hole in a floor of a pit;

(b) a spool and a detonation cord wrapped around the spool in a storage position outside the hole and connected to the spool and to the booster, with the spool being provided for allowing the detonation cord to be unwound from the spool as the booster is moved from the storage position outside the hole to the operative depth in the hole and the spool remains in the storage position; and (c) a stake for locating the spool in the pit floor proximate the hole after the booster is in the operative depth in the hole.

An end of the spool may be formed to receive and locate an end of the booster such that the booster is seated on the spool when the booster assembly is in an upright orientation in the storage position before moving the booster to the operative depth in the hole.

The invention also provides a method of delivering a booster for initiating an explosion of an explosive material in a hole in a floor of a pit into the hole, the method comprising the following steps controlled by an operator in a cabin of the vehicle or at a remote location to the vehicle or controlled as part of autonomous operation:

(a) positioning a booster delivery vehicle in a pit proximate the hole;

(b) removing a booster from a storage unit, such as a bomb-proof storage unit, of the vehicle and moving the booster to a delivery position above the hole; and (c) moving the booster downwardly from the delivery position and inserting the booster at an operative depth in the hole.

The booster may be part of a booster assembly, with the booster assembly comprising in co-axial alignment: the booster, a spool and a detonation cord wrapped around the spool at a storage position outside the hole and connected to the spool and to the booster, with the spool being provided for allowing the detonation cord to be unwound from the spool as the booster is moved from the storage position to the operative depth in the hole and the spool remains in the storage position, and a stake for locating the spool in the pit floor proximate the hole after the booster is at the operative depth in the hole.

With this arrangement, step (b) may comprise moving the booster assembly from the storage unit to an intermediate delivery position and then moving the booster of the booster assembly to the delivery position above the hole.

The method may comprise retaining the spool and the stake of the booster assembly at the intermediate position when the booster is moved to the delivery position.

Alternatively, with this arrangement, step (b) may comprise moving the booster from the storage unit to the delivery position above the hole, with the spool and the stake remaining in the storage unit.

Step (c) may comprise moving the booster downwardly by applying a downward force that moves the booster into the hole to the operative depth.

The method may comprise moving the booster downwardly solely via gravity pulling the booster into the hole to the operative depth.

Step (c) may comprise (i) coupling together the booster and a pusher element that is adapted to apply a downwardly-acting force to the booster, (ii) while coupled together, allowing the pusher element to move the booster and the pusher element downwardly from the delivery position to the operative depth of the booster in the hole, and (iii) releasing the booster from the pusher element when the booster is at the operative depth and withdrawing the pusher element from the hole.

The method may include supplying an explosive emulsion to a required height in the hole prior to positioning the booster into the hole.

The method may include supplying an explosive emulsion to a required height in the hole after positioning the booster into the hole.

Step (b) of the method may comprise removing the booster assembly from the bomb-proof storage unit and moving the booster assembly in an intermediate delivery position and then moving the booster of the booster assembly to the delivery position above the hole.

The method may include retaining the other components of the booster assembly at the intermediate position when the booster is moved to the delivery position.

The vehicle provides the following functions/advantages:

1. Safe storage of a plurality of booster assemblies.
2. Safe transit of a plurality of booster assemblies to a drill hole in a mine.
3. It is possible to insert the booster into the hole without an operator having to stand on the floor of the pit.
4. Accurate placement of the booster at the required depth in the hole.
5. It is possible to seal the magazine when access to the booster assemblies is not required.
6. It is possible to deploy the initiation system of the booster assembly without an operator having to stand on the floor of the pit.

Various features, aspects, and advantages of the invention will become more apparent from the following description of embodiments of the invention, along with the accompanying drawings in which like numerals represent like components.

BRIEF DESCRIPTION OF THE DRAWINGS

Embodiments of the invention are illustrated by way of example, and not by way of limitation, with reference to the accompanying drawings, of which.

Embodiments will now be described more fully hereinafter with reference to the accompanying drawings, in which various embodiments, although not the only possible embodiments, of the invention are shown. The invention may be embodied in many different forms and should not be construed as being limited to the embodiments described below.

DETAILED DESCRIPTION OF EMBODIMENTS

While the embodiments of the initiation system vehicle ("ISV") of the invention described and illustrated herein with reference to the Figures are described in relation to a drill and blast gold mining operation, this is merely illustrative, and it is contemplated that the ISV is applicable to other forms of mining operations and other suitable applications.

FIGS. 1-34 relate to two embodiments of ISVs for storing and delivering a detonator (in the form of an explosive charge located in a casing, referred to herein as "booster 65") of a booster assembly 60 to an operative depth in a drilled hole 90 in a pit floor 91.

Figure 32:
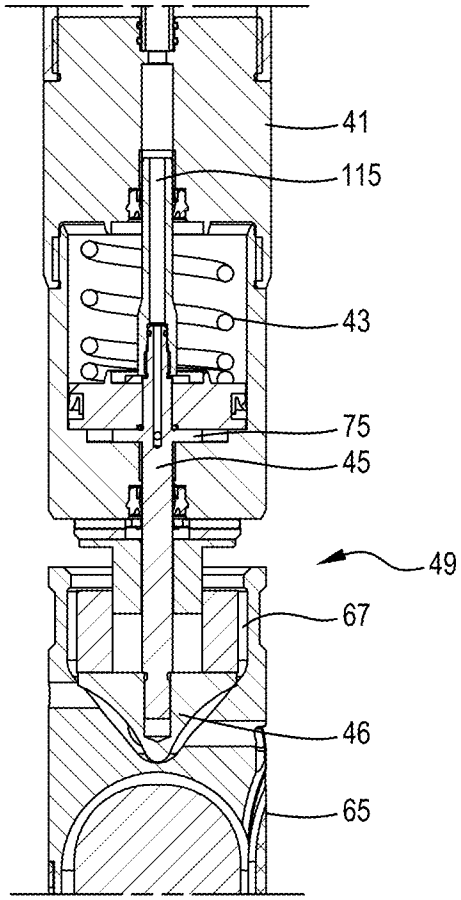
FIG. 32 is a sectional view of the pusher and the booster shown in FIG. 30, with the pusher decoupled from the head of the booster, illustrating the compressible engagement member in a non-compressed state.
Figure 31:
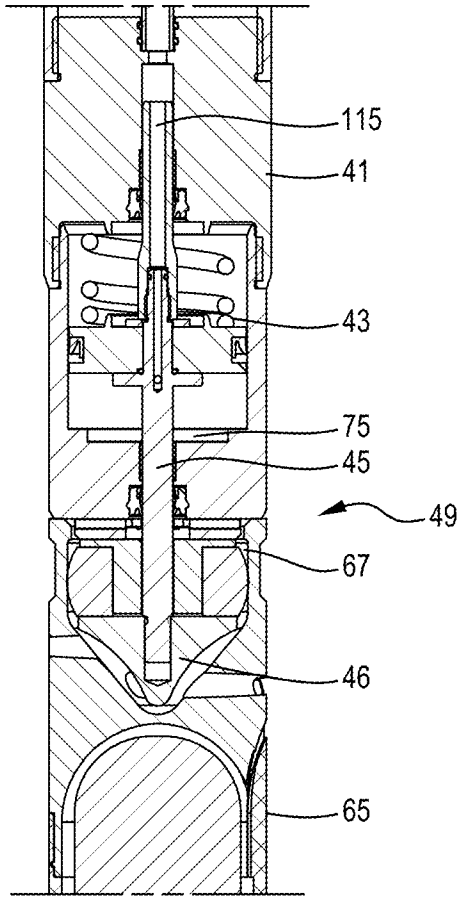
FIG. 31 is a sectional view of the pusher and the booster shown in FIG. 30, with the pusher of the loading assembly coupled with the head of the booster, illustrating the compressible engagement member in a compressed state in order to couple the components together.

The embodiments of the ISVs are described by the reference numerals 1 and 101 in the Figures. FIGS. 1 and 4-6 relate only to the embodiment ISV 1. FIGS. 7-15 relate only to the embodiment ISV 101. FIGS. 30-32 relate to both embodiments ISV 1, ISV 101. FIGS. 16-29 show embodiments of booster assemblies for use with both embodiments of the ISVs. Finally, FIGS. 31 and 32 show an embodiment of a booster crate delivery truck.

In general terms, the booster assembly 60 for use with the vehicles ISV 1 and ISV 101 shown in the Figures comprises (a) the booster 65, (b) a spool 63 with an upright axis (when in a storage position in the ISVs) and a length of detonation cord 66 wrapped around the spool and connected at one end to the spool 63 and at the other end to the booster, and (c) an elongate stake 61 connected at one end to the spool 63, with an upper end of the spool 63 being formed to receive a lower end of the booster 65 such that the booster 65 rests on and is not connected to the spool 63.

Two embodiments of the booster assembly 60 are described in more detail below in relation to FIGS. 16-21 and in a co-pending International application entitled "A Booster Assembly" filed in the name of the applicant on the same day as the subject application, and the disclosure in the provisional application is incorporated herein by cross-reference.

It is noted that the invention is not confined to use with the booster assembly 60 described above and shown in the Figures, and the key assemblies 10, 20, 30 of the initiation system vehicle described below and shown in the Figures may be adapted as required to store and insert different types of booster assembly into drilled holes in pit floors.

Figure 2:
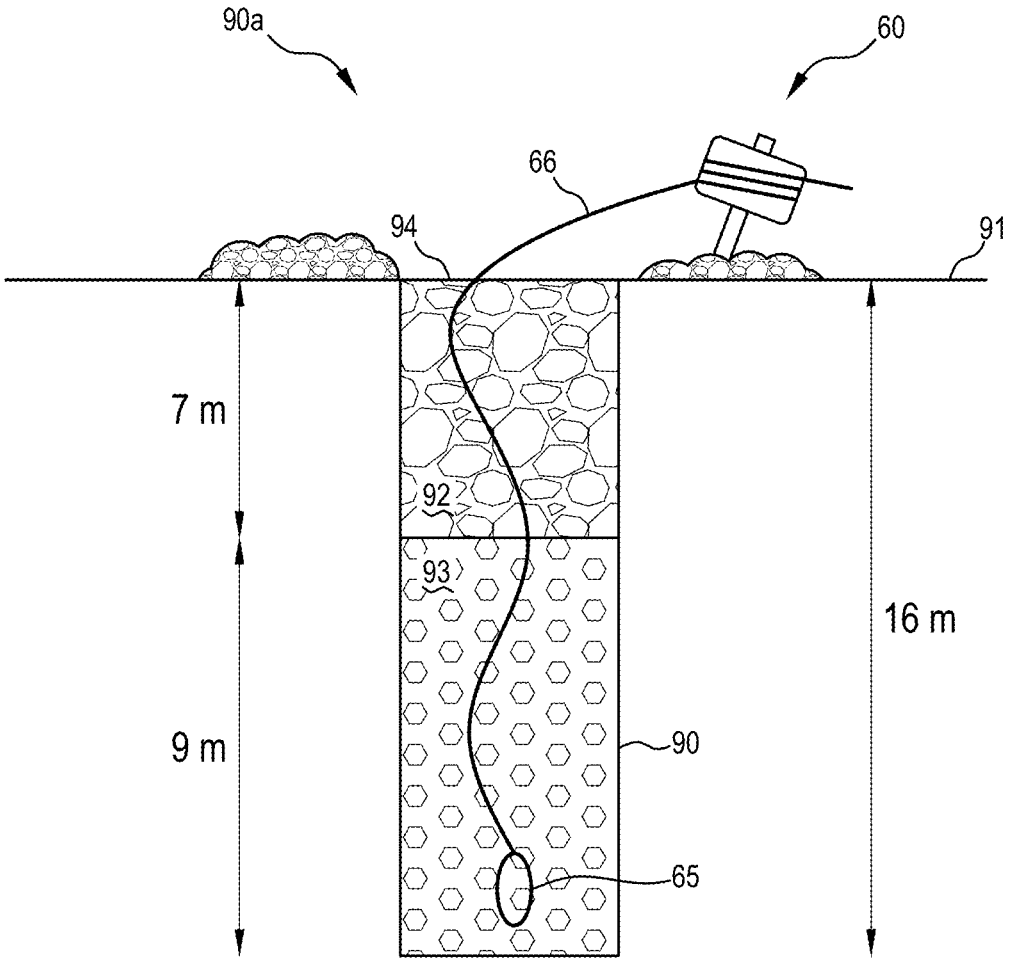
FIG. 2 is a schematic view of a "safe hole", illustrating a stemmed, drilled hole ready to be blasted.

FIG. 2 illustrates in very schematic form a booster 65 positioned in a drilled hole 90 at a selected operative depth and submerged in an emulsion explosive 93 in the hole, with the hole being stemmed and a detonator cord 66 extending from the hole.

As shown in FIG. 2, the drilled hole 90 is filled to a depth of 9 m with the 93 explosive emulsion 93 rated to operate in high temperature pits, such as produced by Dyna Nobel, the booster 65 is submerged in the hole 90 at the selected operative depth (which is a function of the explosive and the detonation requirements for the hole), and the upper 7 m of the hole 90 to the surface of the pit floor 91 is filled with aggregate 92 or other suitable stemming material. It is noted that the drilled hole 90 may be any suitable depth and diameter.

With further reference to FIG. 2, the spool 63 (from which the detonation cord 66 has been unwound) and the attached stake 61 of the booster assembly 60 remain coupled to the booster 65 via the detonation cord 66. As described below, the stake 61 is transferred from a storage position on the ISV to the pit floor 91 and is driven into the pit floor 91 in proximity to the aggregate-filled hole, also referred to as a "safe hole" 90*a*.

Although the hole 90 is filled with explosive emulsion 93 and contains a booster 65, the hole 90 is referred to as a "safe hole" 90*a* as the aggregate 92 has been packed into the opening 94 of the hole 90 and mine personnel can approach the spool 63 with relative safety to tie the detonation cord 66 into other cords 66, in preparation for blasting.

Each of the embodiments ISV 1 and ISV 101 of the ISV comprises:

(a) a storage assembly 10 for storing a plurality of the booster assemblies 60;

(b) a loading assembly 30 for (i) supporting the booster 65 of each booster assembly 60 in turn in a delivery position above the hole 90 and (ii) moving each booster 65 downwardly into the hole and inserting the booster 65 at an operative depth in the hole 90; and (c) a delivery assembly 20 for transporting the booster 65 from the storage assembly 10 to the loading assembly 30.

The storage assembly 10, the loading assembly 30 and the delivery assembly 30 are the key assemblies of ISV 1 and ISV 101. These assemblies store boosters 65 safely and transfer the boosters 65 in turn from storage positions to drilled holes in a pit floor.

Figure 1:
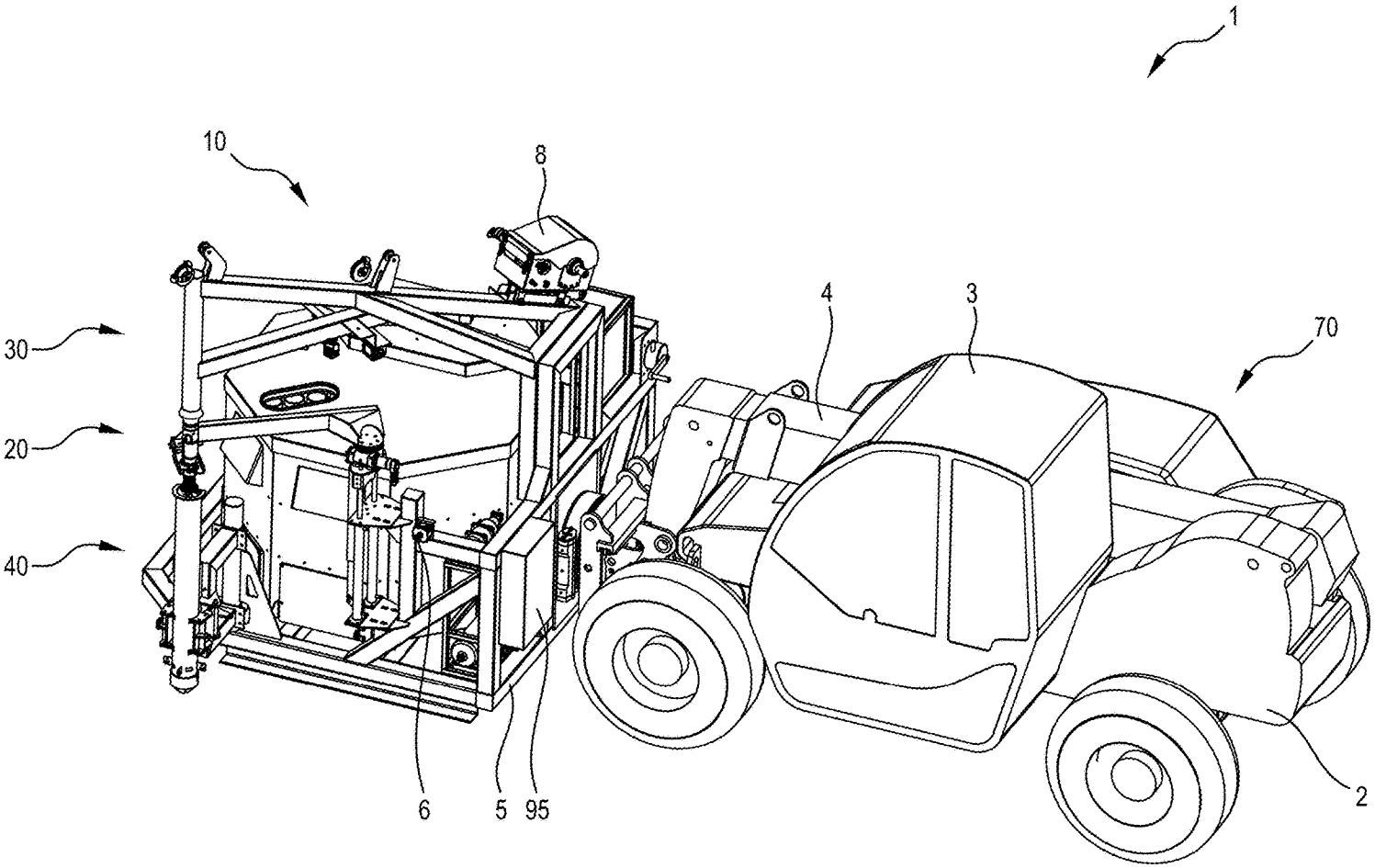
FIG. 1 is a perspective view of an initiation system vehicle according to one embodiment of the invention.

The embodiment ISV 1 of the ISV shown in FIG. 1 comprises the storage assembly 10, the delivery assembly 20, and the loading assembly 30 located on a support frame 5 and mounted to a prime mover 70 (or any other suitable vehicle).

The storage assembly 10 includes bomb-proof box 11 carrying a plurality of booster assemblies 60 in storage positions grouped in booster crates 83 on a rotating carousel 35.

The delivery assembly 20 comprises an adjustable transfer arm 21 having a gripping means in the form of a pair of jaws 23 for gripping a booster 65 or a booster assembly 60 while it is partially within the bomb box 11 and transferring the booster 65 or the booster assembly 60 to the loading assembly 30 positioned above a drill hole 90 on a pit floor 91, as illustrated in FIG. 2.

The multiple assemblies 10, 20, 30 of the ISV 1, described in more detail below, allow an operator to remove each booster assembly 60 in turn from the bomb-proof box 11 and insert a booster 65 of the booster assembly 60 into an emulsion explosive-filled hole 90, such as illustrated in FIG. 2, at a selected operative depth, whilst remaining within the confines of a vehicle cabin 3 or operating the ISV1 from a remote location.

Figure 3:
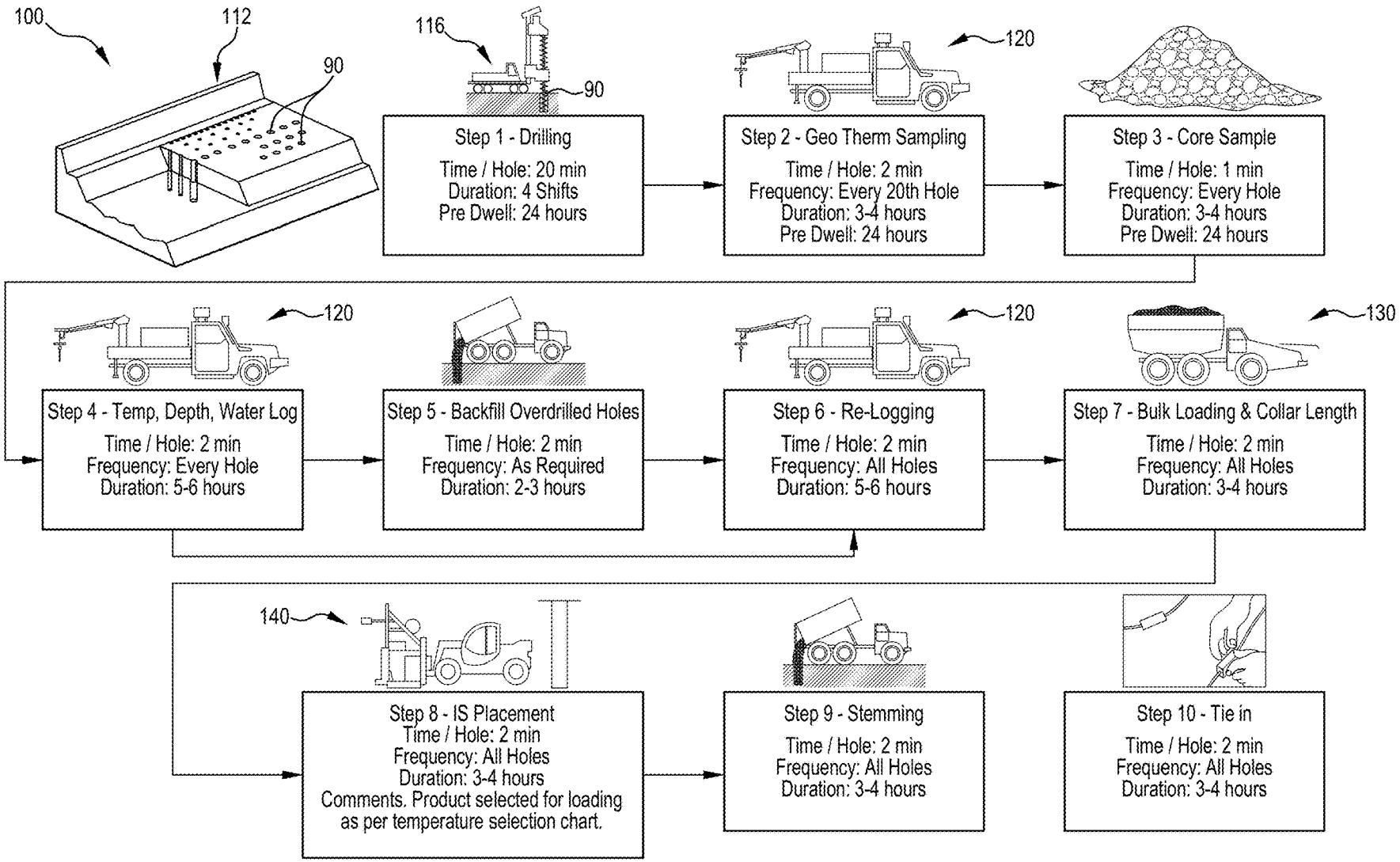
FIG. 3 is a process flow of a mining process configured to reduce mining personnel walking on the pit floor.

FIG. 3 provides a visual representation of an embodiment of a complete mining method and mine utilising the ISV 1. The mining method is described in a co-pending International application entitled "Mining Method and Mine" filed in the name of the applicant on the same day as the subject application, and the disclosure in the provisional application is incorporated herein by cross-reference.

The upper left-hand panel of FIG. 3 illustrates a section of a mine bench 100 in an open pit 112 to be drilled and blasted. The Figure illustrates a plurality of drilled holes 90 for receiving an explosive that can be detonated to blast a block of the bench 100.

The remainder of FIG. 3 is a series of images that form a diagrammatic flowsheet 100 of the method of mining gold-bearing ore in the open pit 112.

In general terms, the mine and the mining method shown in FIG. 3 is an open pit mine operating on a drill and blast basis, with selected blocks of the mine pit being drilled to form a plurality of blast holes as shown in the upper left-hand panel of FIG. 3 that are filled with bulk explosives that are detonated to blast the block, and with excavators (not shown) loading blasted ore into haul trucks (not shown), and with the haul trucks transporting the ore to downstream processing operations.

FIG. 3 shows 10 steps altogether.

The ISV 1 is suitable for use in step 8 of the mining method.

Steps 1-7 define the following steps: drilling a hole 90 such as shown in FIG. 2, sensing and analysing data relating to the drilled hole (such as the dimensions and temperature), making adjustments to the hole as may be required, and filing the hole 90 with an explosive emulsion 93. It is noted that the invention extends to situations in which the booster 65 is inserted into the hole 90 prior to the introduction of the explosive emulsion 93.

More particularly, the mining method described in the specification of the International application comprises the following steps:

(a) positioning a drill rig 116 in a first location in a section of the pit 112;

(b) drilling a hole 90 for explosives at the first location, (c) moving the drill rig 116 to a second and successive locations in the section of the pit 112 and repeating step (b) at each location until a required number of holes 90 have been drilled;

(d) positioning a down-hole measurement vehicle 120 in a first location in the section of the pit 112 and taking measurements in a drilled hole or holes within an operating range for the vehicle while the vehicle is stationary, with a vehicle operator being located in a cabin of the vehicle or at a remote location or with the vehicle being operated autonomously, or with the vehicle being operated autonomously, with the measurements including geothermal sampling of one or more of the drill holes 114—for example, every $20^{th}$ hole, (e) moving the down-hole measurement vehicle to a second and successive locations in the section of the pit 112 and taking measurements in the drilled hole or holes 90 within the operating range for the vehicle at each location while the vehicle is stationary, with the vehicle operator being located in the vehicle cabin or at the remote location or with the vehicle being operated autonomously, (f) positioning an explosives delivery vehicle 130 in a first location in the section of the pit 112 and delivering an explosive, such as an emulsion explosive, to a required depth into the drilled hole or holes 90 within an operating range for the vehicle while the vehicle is stationary, with a vehicle operator being located in a cabin of the vehicle or at a remote location or with the vehicle being operated autonomously;

(g) moving the explosives delivery vehicle to a second and successive locations in the section of the pit and delivering an explosive, such as an emulsion explosive, to the drilled hole or holes 90 within the operating range for the vehicle at each location while the vehicle is stationary, with the vehicle operator being located in the vehicle cabin or at the remote location or with the vehicle being operated autonomously, (h) positioning the ISV 1 (or other embodiments of the ISV of the invention) in a first location in the section of the pit and positioning a booster 65 into the drilled hole or holes 90 within an operating range for the ISV 1 while the ISV 1 is stationary, with a vehicle operator being located in a cabin 3 of the ISV 1 or at a remote location or with the ISV 1 being operated autonomously; and (i) moving the ISV 1 to a second and successive locations in the section of the pit and delivering boosters 65 to the drilled hole or holes 90 within the operating range for the ISV 1 at each location while the ISV 1 is stationary, with the vehicle operator being located in the cabin 3 or at the remote location or with the vehicle being operated autonomously, and (j) initiating the boosters 65 and blasting the section of the pit.

The ISV 1 illustrated in FIGS. 1 and 4-6 is configured to move only the booster 65 of each booster assembly 60 from the bomb-proof box 11 to the loading assembly 30 and to retain the other components of the booster assembly 60 in the bomb-proof box 11.

In contrast, the ISV 101 of FIGS. 7 and 9-12 illustrates an embodiment of the ISV where each entire booster assembly 60 is removed from the bomb-proof box 111 and delivered to an intermediate position proximate the loading assembly 130—from this location, only the booster 65 is inserted into the drill hole 90 and the spool 63 and the stake 61 of the booster assembly 60 are retained at the intermediate position.

Where components of the booster assembly 60 are retained in the bomb-proof box 11, as is the case in of ISV 1 shown in FIGS. 1 and 4-6, the detonation cord 66 (shown in FIG. 2) becomes draped across the storage assembly 10 between the spool 63 and the booster 65 as the booster 65 is moved from the bomb-proof box 11 and inserted into a hole 90. In the case of ISV 101 illustrated in FIGS. 7 and 9-12, the spool 63 and thus the attached detonation cord 66 and the stake 61 are completely removed from the bomb-proof box 111 and moved to an intermediate position near the hole 90 prior to being moved again and driven into the pit floor 91 adjacent the safe hole 90*a*—as shown in FIG. 2.

Figure 4:
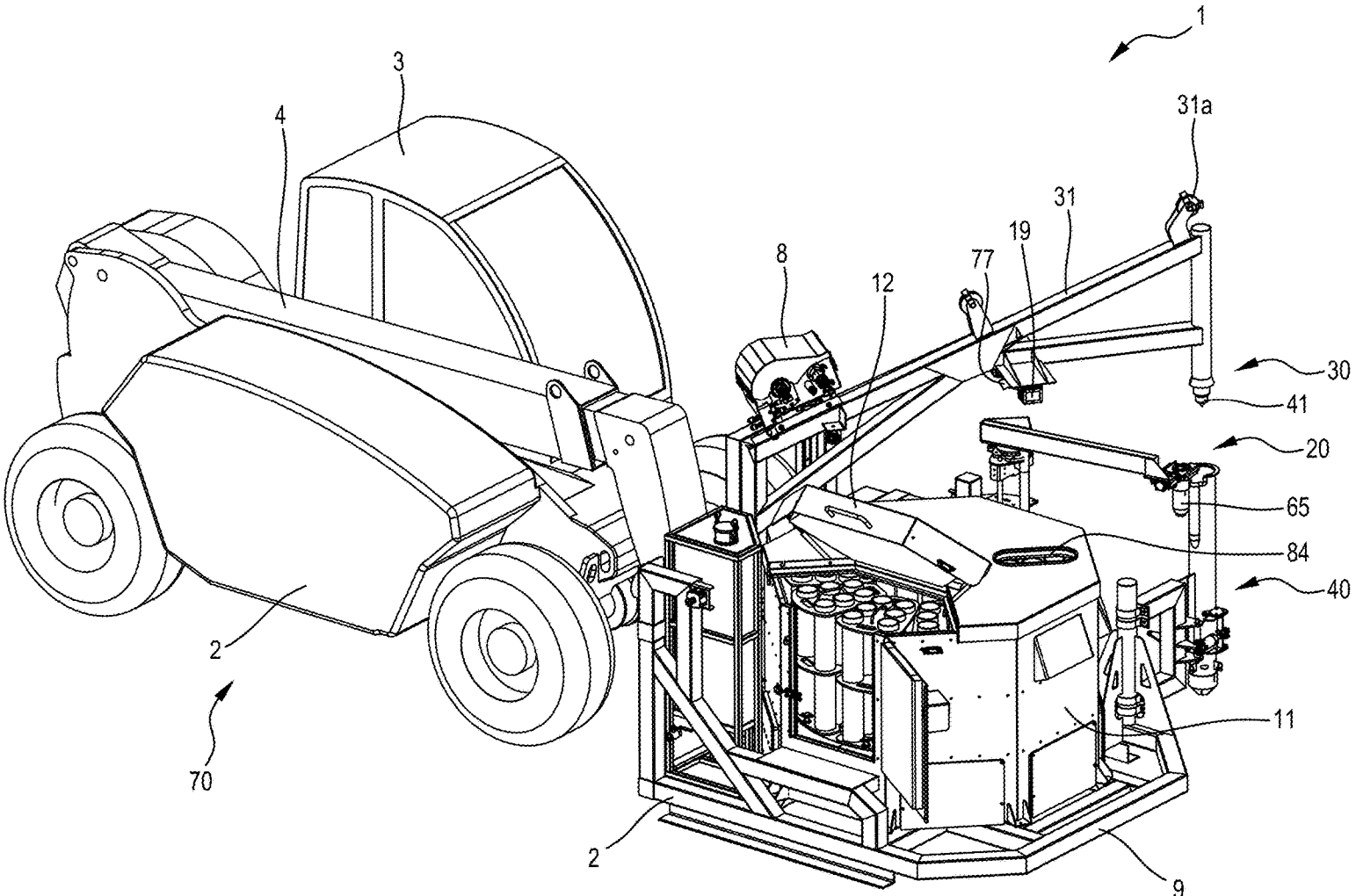
FIG. 4 is a perspective view of the vehicle of FIG. 1 illustrating a booster storage assembly, booster delivery assembly, and a booster loading assembly.

FIG. 4 illustrates the prime mover 70 of ISV 1 removably coupled to the support frame 5 upon which the operative assemblies 10, 20, 30 of the ISV 1 are mounted. The frame 5 comprises steel beams which mount and support the various assemblies of the ISV 1. A front portion of the frame 5 wraps around the ISV 1 to form a bumper 9. The bumper 9 provides protection from impacts with minor obstacles around the pit floor 91.

The prime mover 70 is a vehicle having a cab 3 supported on a wheeled chassis 2. It is noted that the prime mover may be any other suitable vehicle. The chassis 2 also supports a mounting arm 4 operatively engaged to the frame 5 via a coupling 86. The coupling 86 allows the frame 5 to be pivoted about the arm 4. The coupling 86 allows the frame 5 to be disengaged and re-engaged from the arm 4 and thus removably attached to an alternative prime mover 70.

Illustrated in FIG. 4, the frame 5 of ISV 1 is a quadrilateral shape, having the bomb-proof box 11 of the storage assembly 10 mounted centrally thereon.

On a first side of the frame 5, there is a winch arm 31 supporting a winch 8. These components form part of the loading assembly 30. The winch arm 31 is pivotable about the frame 5 to provide access to a plurality of holes 90 without the need to move the ISV 1. Nevertheless, typically (although not necessarily), the ISV1 will be moved from one hole 90 to the next hole 90 rather than be used to insert boosters 65 into multiple locations while the ISV1 is at one location.

At a distal end of the winch arm 31 is a fairlead 31*a* which guides a winch cable 32. The winch cable 32 is shown in FIG. 6. It is not shown in similar Figures such as FIGS. 4, 5, and 7. The winch cable 32 extends between the winch 8 and a pusher 41. These components are further components of the loading assembly 30.

The loading assembly 30 also comprises at least one camera 19 and at least one light 77 mounted to the distal end of the winch arm 31 to assist in positioning and launching the booster 65 into the hole 90. The light or lights 77 and the camera or cameras 19 are preferably mounted in proximity to the pusher 41 to make it possible for the operator to visualise and analyse the hole 90 and the hole surroundings before, during and after loading of the booster 65. The camera(s) 19 can be an IR camera to take thermal readings before, during or after loading of the booster 65. The camera(s) 19 and the light (s) 77 may be any suitable products.

The bomb-proof box 11 has an access hatch 12 which allows for loading of the booster crates 83 therein. On a top surface of the bomb-proof box 11 there is also provided a booster access port 84, through which a booster 65 or booster assembly 60 can be controllably ejected from within the bomb-proof box 11. When, in use, the booster 65 is projected though the access port 84 and above the top of the bomb-proof box 11, the delivery assembly 20 can access the booster 65 and transfer the booster 65 to the loading assembly 30.

Figure 5:
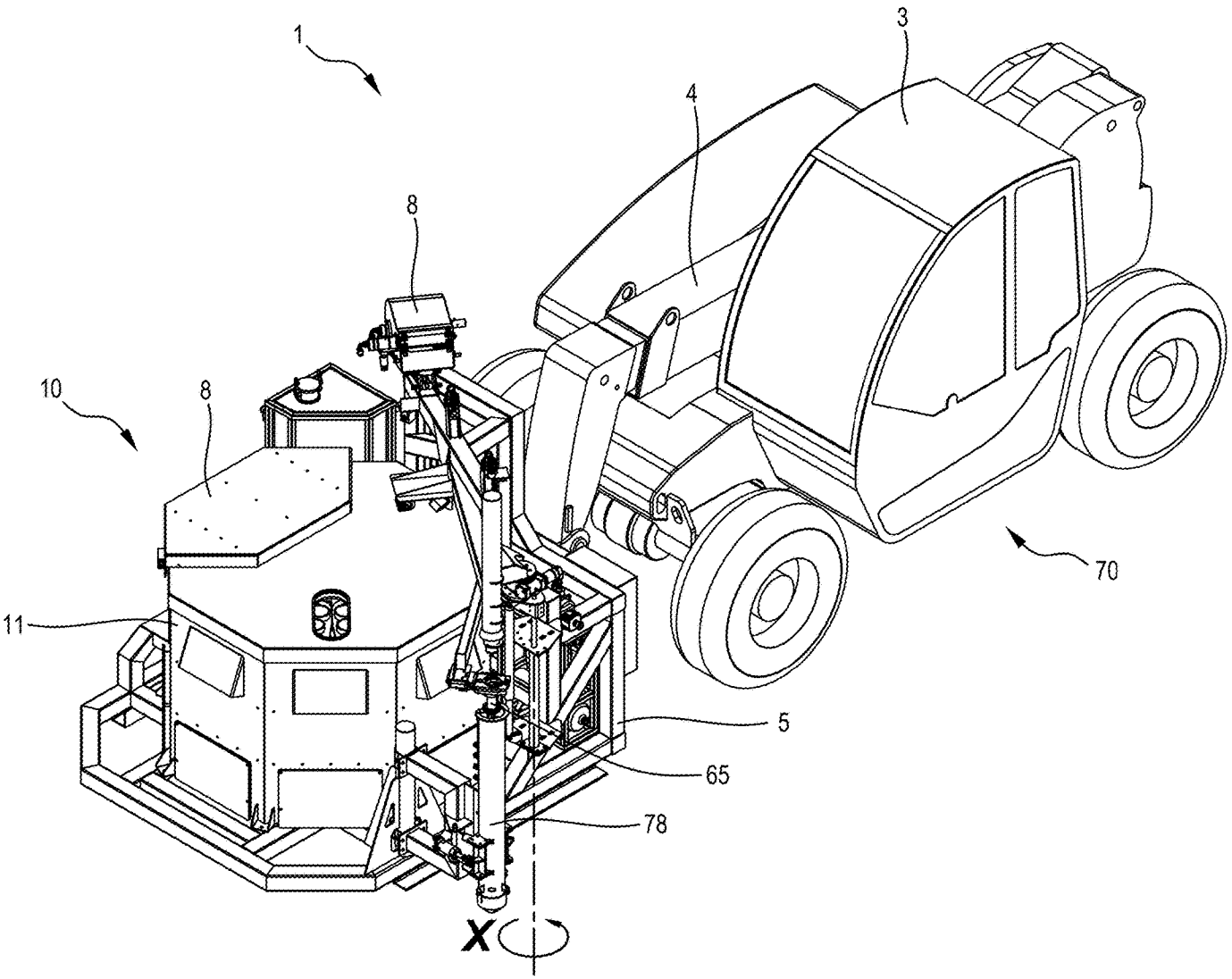
FIG. 5 is a perspective view of the vehicle of FIG. 1, from an opposing side of the vehicle.
Figure 6:
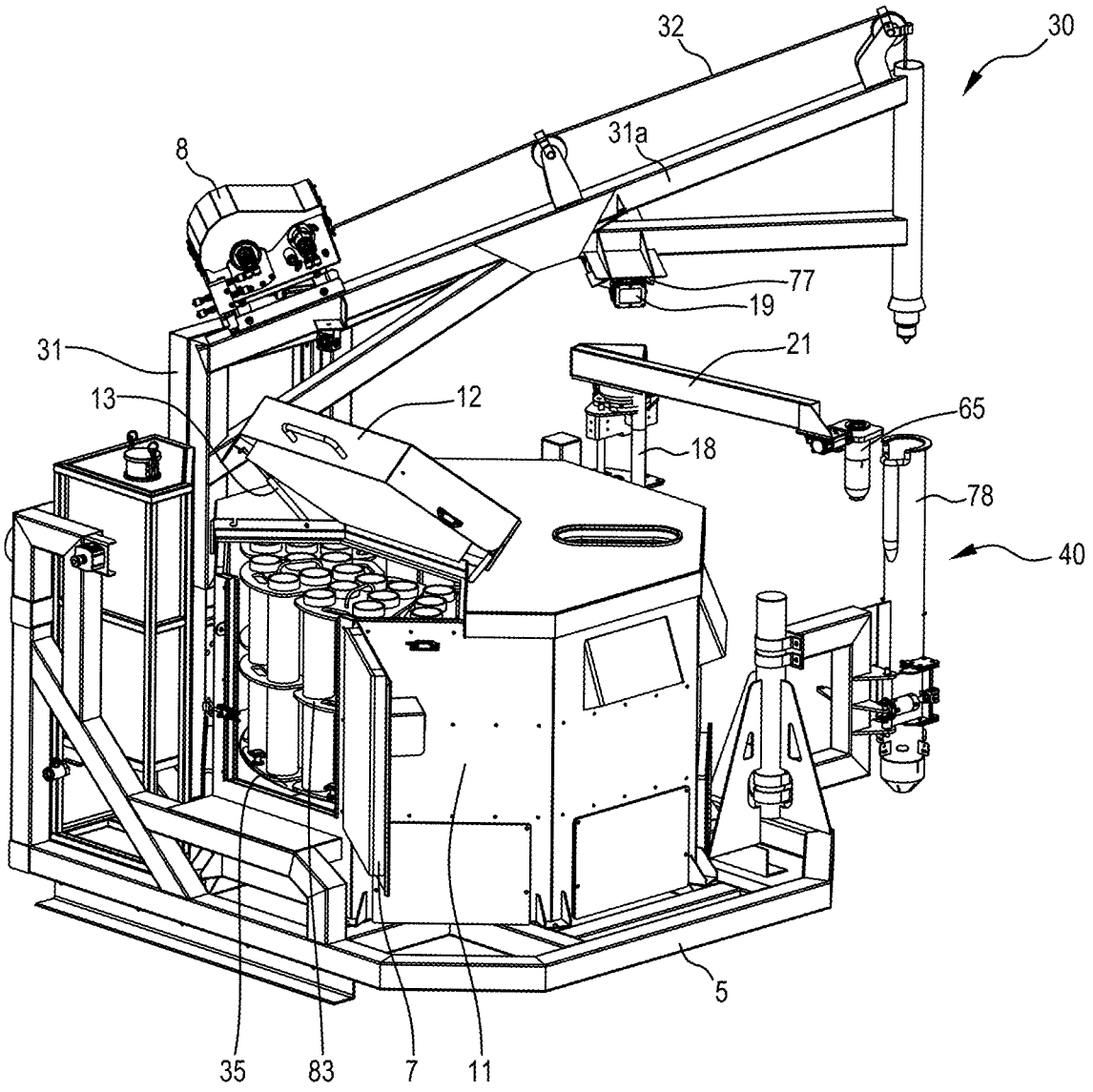
FIG. 6 is a perspective view of the booster delivery assembly of the vehicle of FIG. 1 delivering a booster from the storage assembly to the loading assembly.

FIG. 5 illustrates the delivery assembly 20 of ISV 1 having the transfer arm 21 pivotally mounted to the frame 5. In some embodiments the transfer arm 21 can be mounted to the bomb-proof box 11. The transfer arm 21 pivots about an axis "x" located adjacent a side wall of the bomb-proof box 11. The transfer arm 21 pivots across the top of the bomb-proof box 11 to grip the booster 65 (in the case of the ISV 1 embodiment) or the booster assembly 60 (in the case of the ISV 101 embodiment) as it is controllably moved upwardly through the access port 84. The transfer arm 21 is provided with a gripping member 23, illustrated in FIG. 5 as a pair of jaws 23*a*, 23*b*, which at least partially encircle the booster 65 to reliably grasp and transfer the booster 65 to the loading assembly 30. It is contemplated that other forms of gripping member 23 can be used.

Once the booster 65 or booster assembly 60 is securely held in the jaws 23*a*, 23*b*, the transfer arm 21 is raised on a transfer arm booster 18, which allows the booster 65 or booster assembly 60 to be lifted clear of the access port 84. Once clear of the access port 84, the booster 65 or booster assembly 60 is rotated over the bomb-proof box 11 to a delivery tube 78 of the loading assembly 30. The purpose of the delivery tube 78 is to help guide boosters 65 into drilled holes 90.

Turning to FIG. 6, the bomb-proof box 11 of ISV 1 is illustrated in an open configuration. The access hatch 12 is raised to enable booster crates 83 to be loaded and removed from the interior of the box 11. A loading door 7 is also provided to facilitate loading and unloading of the booster crates 83 and maintenance of the internal systems of the box 11.

Each of the booster crates 83 contains between 1 and 6 booster assemblies 65 that are preloaded into the box 11 prior to the ISV 1 travelling onto the pit floor 91. Each of the booster crates 83 is locked into position on a rotating plate or carousel 35 which internally rotates about a central upright axis with the box 11 to align a predetermined booster assembly 65 with the access port 84.

Activation of a lifting assembly 50 below the carousel 35 raises a selected booster assembly 65 though the access port 84 so that the booster 60 of the booster assembly 65 can be received and gripped by the jaws 23*a*, 23*b* of the transfer arm 21. In this position, the transfer arm 21 can move the booster 60 clear of the other components of the booster assembly 65, which are retained in the box 11. The lifting assembly 50 is described in more detail in conjunction with FIGS. 14A and 14B, herein.

The access hatch 12 has handles 51 (see FIG. 4) to assist in opening the hatch 12 and, once open, the hatch 12 has struts 13 (see FIG. 6) to hold the hatch 12 in the open configuration. The struts 13 can be gas struts or hydraulic struts or any other suitable option. The hatch 12 is approximately half the area of the top of the box 11 in this embodiment to allow ample room for loading and unloading of the crates 83. The invention is not confined to a particular size hatch 12.

To one side of the hatch 12 there is provided an emergency stop (e-stop) 6 (see FIG. 6) for shutting down the various assemblies of the ISV 1 in an emergency.

FIG. 6 also illustrates the transfer arm 21 holding a booster 65 at a position along a pivoting path of movement toward the delivery tube 78. The delivery tube 78 is rigidly mounted to the frame 5. As the booster 65 is swung into position above the tube 78, the booster 65 is brought into alignment with the pusher 41 of the loading assembly 30.

When the storage assembly 10 is being transported to a drilled hole 90, the access port 84 of the storage assembly 10 is sealed by an actuated lid 36, which ensures full containment of the contents of the bomb-proof box 11. The actuated lid 36 is only opened to unseal the access port 84 once a booster 65 of a selected booster assembly 60 is ready to be ejected from the box 11.

Figure 7:
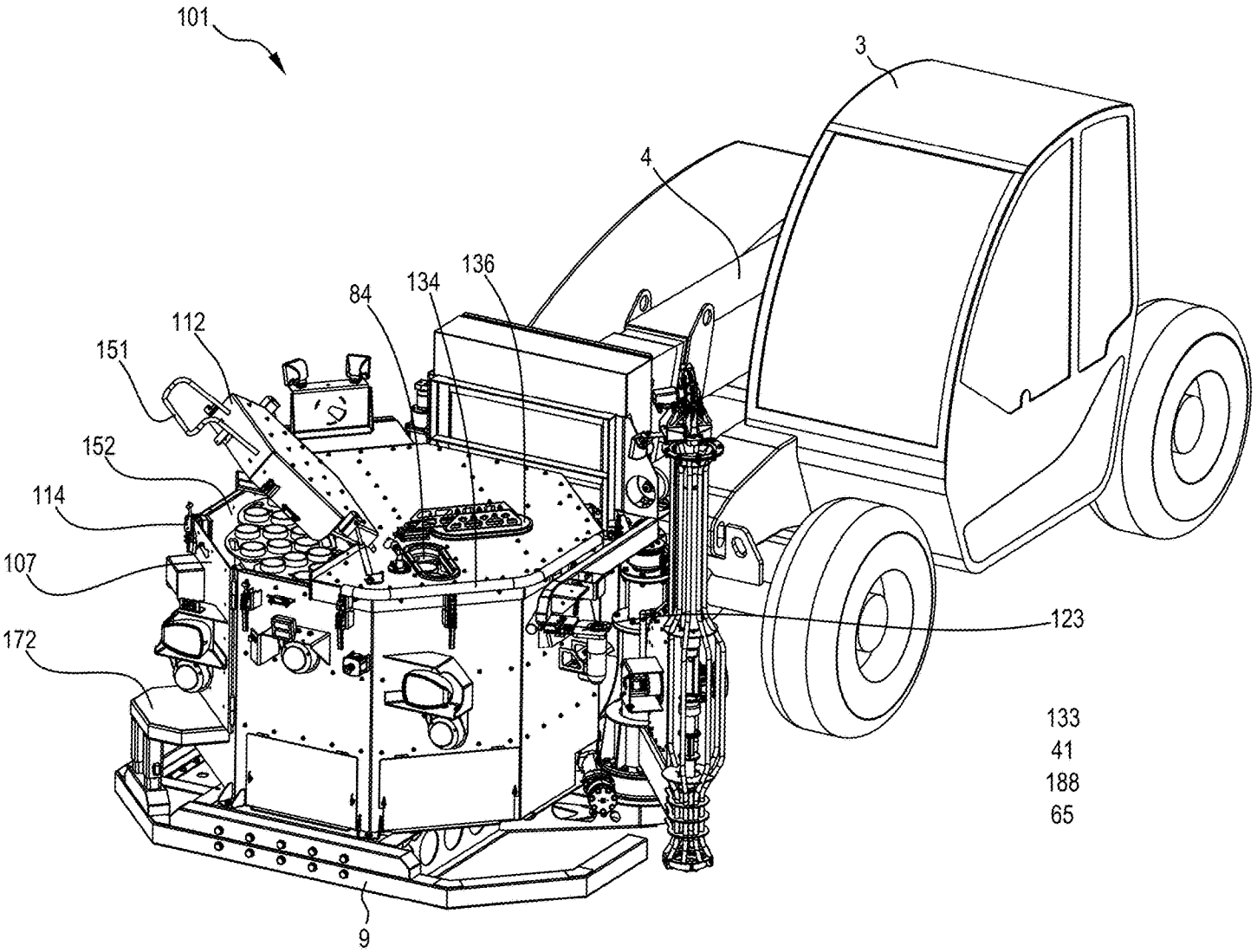
FIG. 7 is a perspective view of an initiation system vehicle according to another, although not the only other, embodiment of the invention.

Turning now to FIG. 7, there is illustrated alternative embodiment ISV 101 of the ISV, having a more compact loading assembly 130 than that of ISV 1. An upper opening 152 in the bomb-box 111 and the hatch 112 of the bomb-box 111 have been reduced in area to reduce the number of booster assemblies 65 exposed when the hatch 112 is in the open configuration. The frame 5 also supports a loading platform 72, to assist an operator manually loading the crates 83.

The loading assembly 130 comprises a loading cage 133 which houses the pusher 41.

Also illustrated in FIG. 7, in use, the entire booster assembly 60 rather than the booster 65 only as is the case with the embodiment ISV 1 is removed from the box 111 and delivered by the transfer arm 121 to a holder 188 (i.e. an intermediate position) adjacent the cage 133. This reduces the distance over which the detonation cord 66 trails. This arrangement also advantageously displaces the detonation cord 66 of the booster 65 from the remaining live booster assemblies 60 within the bomb-proof box 111.

The holder 188 is a frame made from a plurality of hoops which, in use, receive the stake 61 of the booster assembly 60. The hoops are engaged with the winch arm 131 to keep the cage 133 clear of external attachments. While the stake 61 is held in the holder 188, the spool 63 of the booster assembly 60 is free to rotate and pay-out detonation cord 66 as the booster 65 descends into the hole 90. A tie-off slot 68 (see FIG. 16) is provided on the spool 63 to prevent further pay-out of the detonation cord 66 when the booster 65 reaches the operative depth in the hole 90. The holder 188 may be any suitable arrangement.

Figure 8:
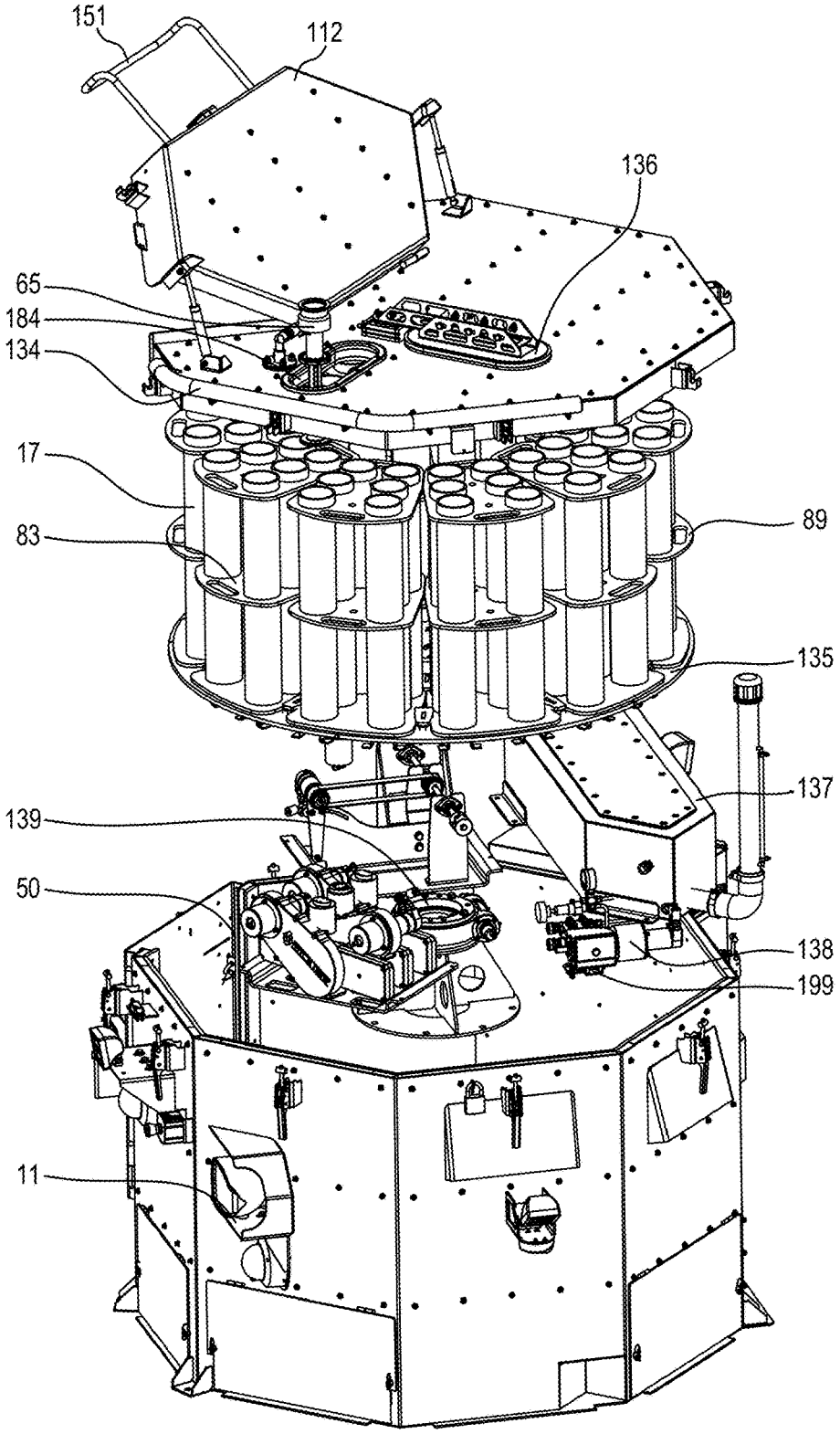
FIG. 8 is an exploded perspective view of the booster storage assembly of the vehicles shown in FIG. 7, illustrating a bomb-proof box on a rotatable carousel for accessing a plurality of booster assemblies preloaded into portable booster crates.

FIG. 8 illustrates an exploded view of the storage assembly 110 of ISV 101, wherein the top of the bomb-proof box 111 is removed from the box 111.

A detonation cord guide 134 is positioned around a portion of a periphery of the top of the box 111 in which the detonation cord 66 (not shown in FIG. 8) lies when the booster 65 only is removed from the box 111. The guide 134 assists in keeping the detonation cord 66 out of contact with any of the other systems of the ISV 101. An additional detonation cord guide 122 is located along the length of the transfer arm 121 to minimise snagging opportunities with moving assemblies, for example the transfer arm 121 of the delivery assembly 120.

With further reference to FIG. 8. projecting out of the access port 84 are the booster 65 and the spool 63 of a booster assembly 60 awaiting contact with the jaws 123*a*, 123*b* of the transfer arm 121.

Below the top of the box 111 is a circular arrangement of 6-8 booster crates 83 each containing 6 booster assemblies 60. Each of the crates 83 is mounted in a predetermined location onto the carousel 135 to be rotated in turn to align with the access port 184.

Mounted to a side wall of the bomb-proof box 111 is a water tank 137 and water pump 138.

Mounted under the carousel 135 is a slew drive 139 for rotating the carousel 135, the lifting assembly 50 for raising the booster assemblies 60, and a radio frequency identification (RFID) reader 199 for monitoring and recording the status of each crate 83.

The RFID reader 199 makes it possible to locate each booster assembly 60 in a particular crate 83. This is important in order to match a booster 65 having particular detonation characteristics with the requirements for a drilled hole 90. The RFID reader 199 also facilitates monitoring of the status of the booster crates 83 and the number and location of the remaining booster assemblies 60 within the crates 83.

Figure 9A:
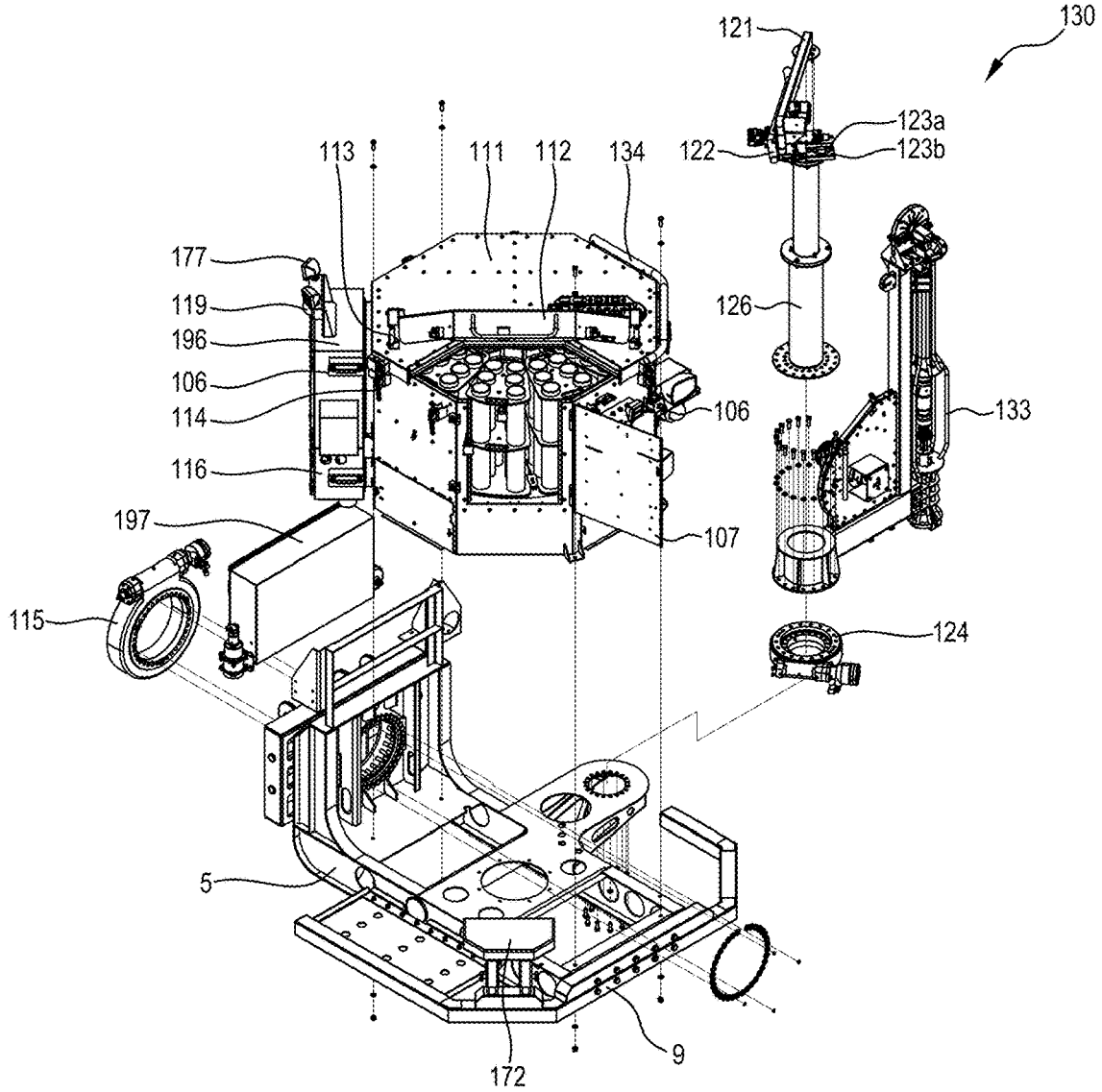
FIG. 9A is an exploded perspective view of the booster storage assembly and the booster delivery assembly for accessing and removing individual booster assemblies from the bomb-proof box of the vehicle shown in FIG. 7.

The carousel 135 is provided with a manual-rotation hand pump 114, illustrated in FIG. 9A. This hand pump 114 can rotate the carousel 135 when the slew drive 139 is not being used to adjust the alignment of the crates 83 with the access port 184.

FIG. 9A illustrates a number of sub-assemblies to the storage assembly 110 of ISV 101, for operating and rotating the box 111. These subassemblies include, but are not limited to, an electrical enclosure 196, a hydraulic enclosure 116, a carousel drive system 115, and a pneumatic enclosure 197. Additional emergency stops 106 are located about the storage system 110 to shut down the peripheral subassemblies, as required.

Additional arrays of lights 177 and cameras 119 are disposed about the storage assembly 110 and its subassemblies to illuminate and analyse conditions about the ISV 101 when in use.

In the exploded view of FIG. 9A, the transfer arm 121 and the transfer arm booster 118 are illustrated, detached from the box 111 and frame 5. A slew ring spacer 124 is mounted to the frame 5 upon which the booster 118 is mounted to rotate about the frame 5.

Figure 9B:
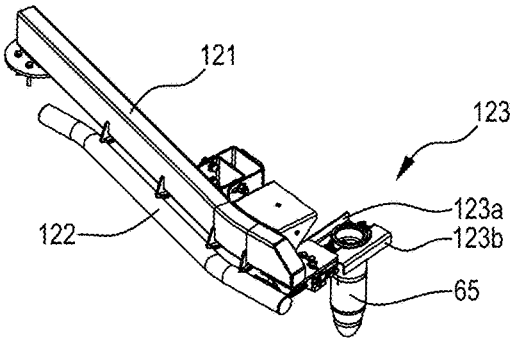
FIG. 9B is a perspective view of a transfer arm shown in FIG. 9A for carrying the booster assembly between the storage assembly and a loading assembly.
Figure 9C:
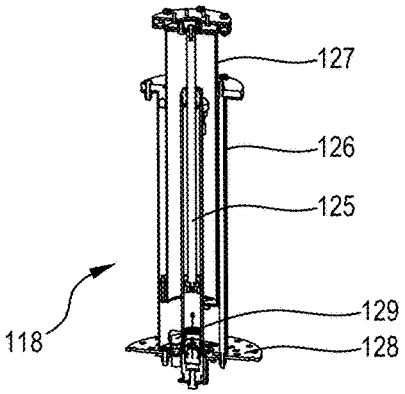
FIG. 9C is a perspective view of a booster unit shown in FIG. 9A for translating the transfer arm to deliver the booster or booster assembly to the loading assembly.

The transfer arm booster 118 is illustrated in cross-section in FIG. 9C having a hydraulic cylinder 125 movable mounted within a support post 126. The support post 126 is mounted to the slew ring spaced 124 by a mounting flange 128 and bolted thereto.

A proximity sensor 129 is located centrally at the base of the support post 126 to monitor the location of the transfer arm 121.

Within the support post 126, a telescoping post 127 is engaged with the hydraulic cylinder 125, to raise and lower the telescoping post 127, and thus raise and lower the attached transfer arm 121, relative to the frame 5.

The transfer arm 121 is illustrated in detail in FIG. 9B. The arm 121 includes a detonation cord guide 122 extending along a length of the arm 121. A proximal end of the arm 121 is mounted to the telescoping post 127 of the transfer arm booster 118, while a distal end of the arm 121 supports a pneumatic gripper 123 comprising a pair of jaws 123*a*, 123*b*. The pair of jaws 123*a*, 123*b* are configured to move between an open configuration and a closed configuration to release and capture the booster 65 (in the case of the ISV 1 embodiment) or the booster assembly 60 (in the case of the ISV 101 embodiment) when pneumatically activated or deactivated. The booster 65 and the spool 63 both comprise a common neck profile 71 that cooperates with the pneumatic gripper 123 to provide a secure engagement between the transfer arm 121 and the booster 65 or the booster assembly 60, depending on the ISV 1 or ISV 101 embodiment.

Extending from the transfer arm booster 118 is a rigid winch arm 131 which supports the winch 108 of the loading assembly 130. The loading assembly 130 comprises the loading cage 133, a loading chute 189, the pusher 41 and attached winch cable 132. The winch 108 is activated to pay-out or haul-in the winch cable 132 to lower or raise the pusher 41, respectively.

The pusher 41 is stored in a retracted configuration whereby the pusher 41 is retracted in a chute 198 (not shown in 10A and 10B). The chute 198 surrounds the pusher 41 and protects a booster engagement mechanism 149 thereon. The booster 65 is brought towards the cage 133, wherein the booster 65 fits between bars of the cage 133 to be centrally located therein. This brings the booster 65 and a booster dock 69 into alignment with the pusher 41 and the booster engagement mechanism 49. The winch 108 is activated and the cable 132 is paid-out to lower the pusher 41 within the chute 198 and engage the booster engagement mechanism 49 into the booster dock 69 to thereby couple the pusher 41 and the booster 65 together. The booster engagement mechanism 49 is activated to lock the pusher 41 to the booster 65. This mechanism 49 is described in further detail in relation to FIGS. 16-20.

The combined weight of the pusher 41 and the booster 65 is sufficient to push the pusher 41 and the booster 65 downwards through the explosive emulsion 93 and insert the booster 65 at a selected operative depth within a hole 90. It is noted that the weight of the pusher 41 and/or the booster 65 may be adjusted as required to insert the booster 65 at the required depth having regard to factors, such as the viscosity of the emulsion explosive 93 in the hole 90.

Various sensors can be attached to the winch 108 and the cable 132 to monitor the progress of the booster 65 as it descends into the hole 90. For example, if the rate of descent changes, a signal can be feedback to the operator in the cabin 3 that the booster 65 may have become caught or impeded in some manner. Similarly, if the winch cable 132 becomes slack a signal can be sent to alert the operator in the cabin 3 that the booster 65 has reached a base of the hole 90.

Once the booster 65 has reached the selected operative depth within the hole 90, the booster engagement mechanism 49 is deactivated severing the engagement between the booster 65 and the pusher 41, such that the winch 108 is placed into reverse, the winch cable 132 hauled-in and the pusher 41 ascends the hole to be returned to the retracted configuration with the chute 198.

The chute 198 and the cage 133 are formed from a series of constant diameter, elongate rods 133*a*. A plurality of rods 133*a* (between 6 and 10) are arranged equidistantly in a circular formation. The diameter of the arrangement of rods 133*a* sufficient to house the pushed 41 in the chute 198. A portion of the chute 198 greatly increases in diameter to form the cage 133 and is sufficiently wide to house the pusher 141 and the booster 65 therein, as illustrated in FIGS. 10A and 10B.

Figure 10A:
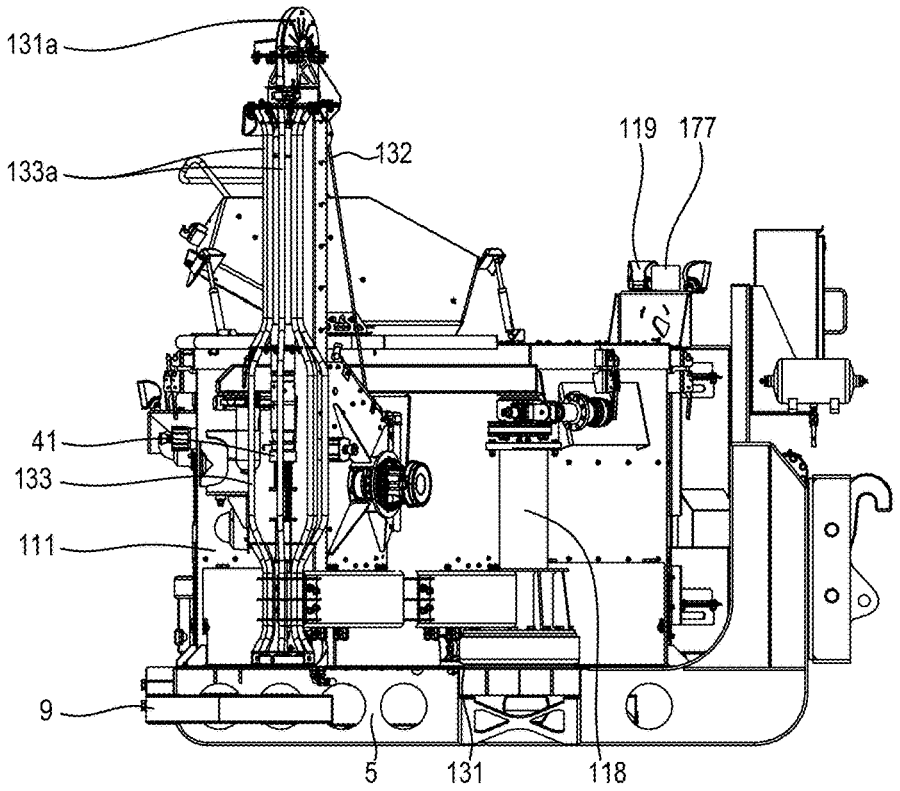
FIG. 10A is a side view of the storage assembly, the delivery assembly, the loading assembly and the launching assembly of the vehicles shown in FIG. 7, illustrating a holder retaining a portion of the booster assembly outside of the storage unit.

In FIG. 10A, the booster assembly 60 is illustrated located in the holder 188 adjacent to the chute 198 of ISV 101. The pusher 41 can also be seen in FIG. 10A, within the cage 133 portion of the loading assembly 130.

Figure 10B:
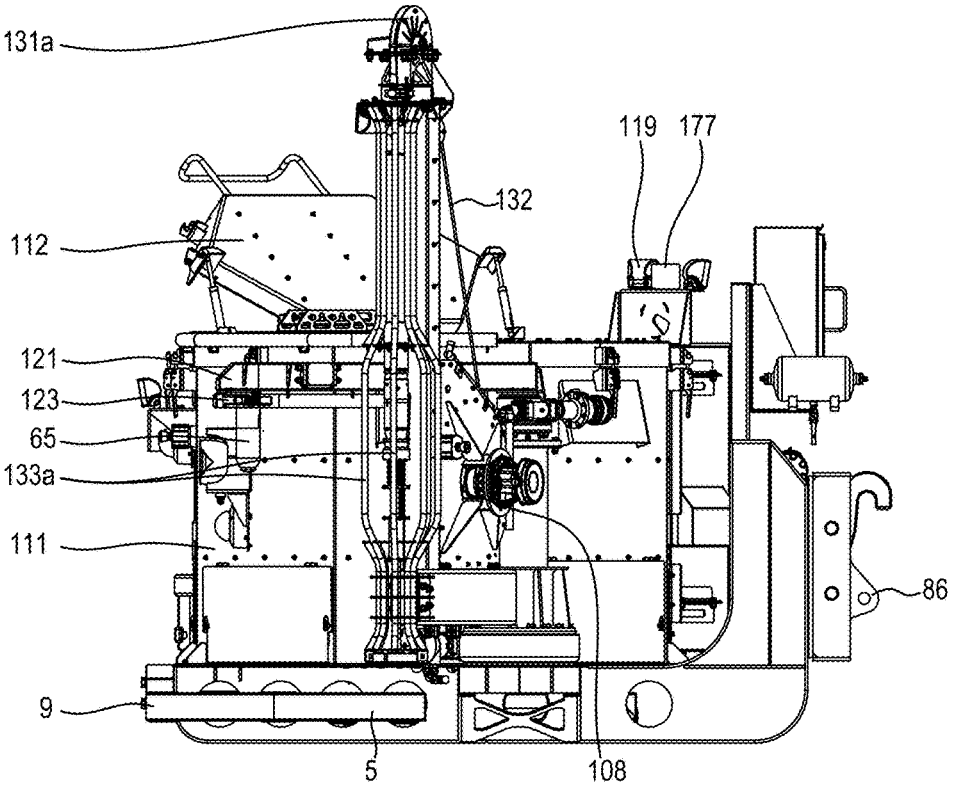
FIG. 10B is a side view of the storage assembly, the delivery assembly, the loading assembly and the launching assembly shown in FIG. 10A, illustrating a booster separated from the booster assembly prior to being received by the loading assembly.

FIG. 10B illustrates the booster 65 being transferred towards the cage 133 without the stake 61 and spool 63, which retain the end of the detonation cord 66 (not shown in this Figure). The booster 65 is then inserted by the transfer arm 121 into the cage 133 and the cord 66 is left free to unspool as the booster 65 descends.

Figure 11A:
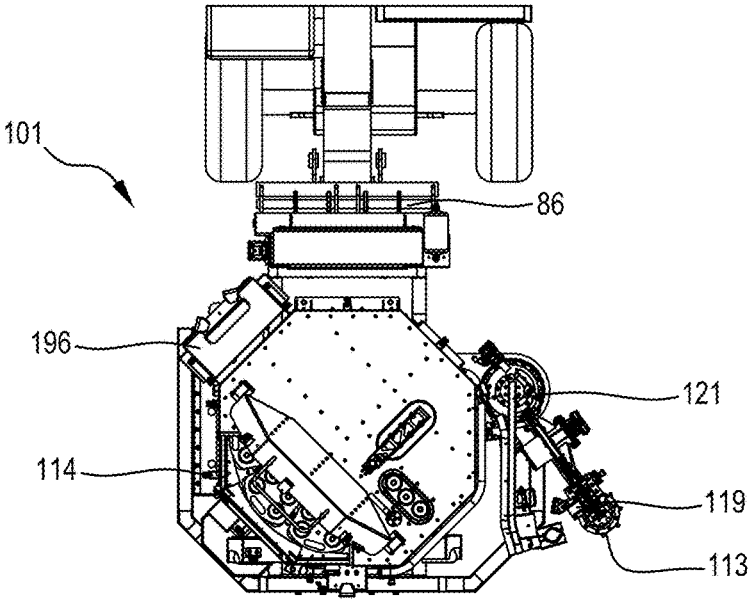
FIG. 11A is a top view of the vehicle shown in FIG. 7, illustrating a mounting frame of the storage assembly rotatably mounted to a mounting arm of the prime mover.
Figure 11B:
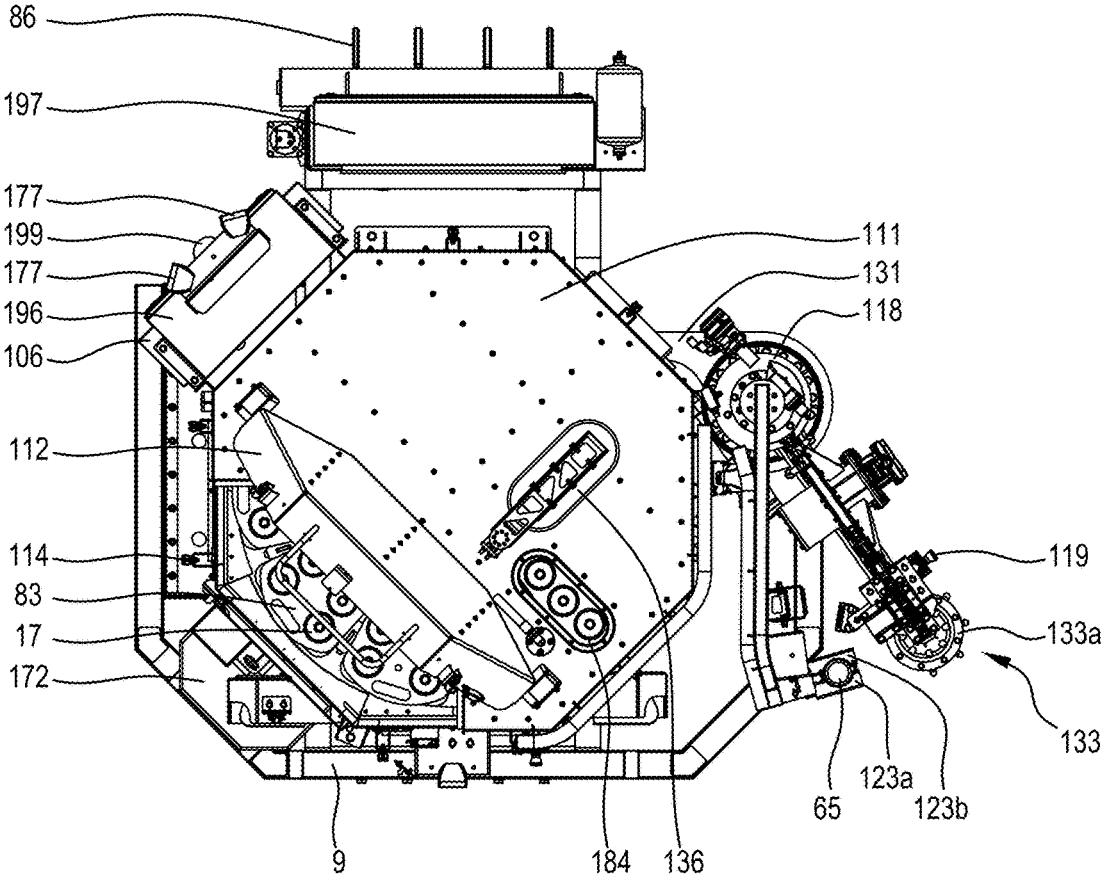
FIG. 11B is an enlarged top view of the bomb-proof box shown in FIG. 11A, illustrating an opening hatch for loading the portable booster crates.

FIGS. 11A and 11B illustrate the ISV 101 in a plan view, which show the travel of the booster 65 from the access port 184 to the cage 133. The actuator lid 136 is rotatable mounted to the top of the box 111 and pivots between its open and closed configurations. As each booster assembly 60 is raised out of the box 111 for retrieval by the transfer arm 121, the RFID reader 199 records the ejection of the booster assembly 60 and the unique identifying number thereof. FIG. 11B illustrates three storage tubes 17 aligned with the access port 184, having only one remaining booster assembly 60 therein, and a second booster assembly 60 in the jaws 123*a*, 123*b* of the transfer arm 121.

Figure 12A:
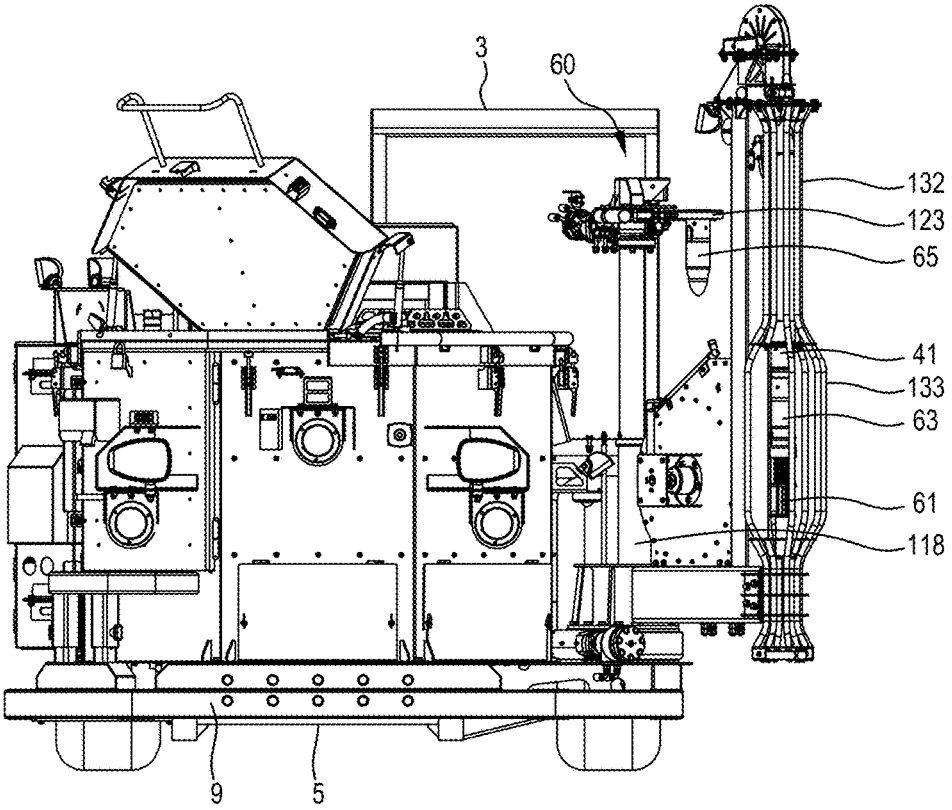
FIG. 12A is a front view of the loading assembly mounted to the frame of the vehicle shown in FIG. 7, illustrating a booster assembly within the transfer arm of the delivery assembly.
Figure 12B:
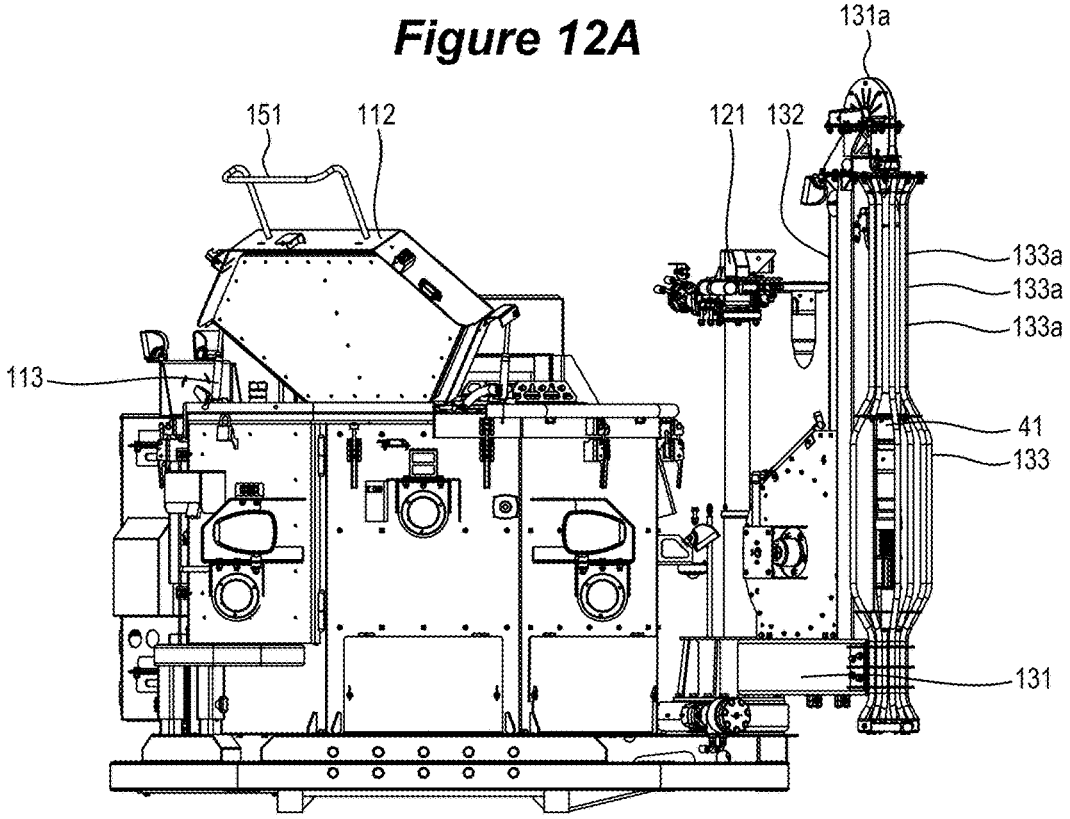
FIG. 12B is a front view of the loading assembly mounted to the frame detached from the prime mover shown in FIG. 12A, illustrating a booster detached from the booster assembly within the transfer arm of the delivery assembly.

FIGS. 12A and 12B are front views of the ISV 101 illustrating the compact design of this embodiment. The cage 133 and fairlead 131*a* extend to a height of about 2500 mm from an underside of the frame 5, which is only marginally taller that the cabin 3 of the prime mover 70. Also illustrated in FIG. 12A is the holder 188 for supporting the booster assembly 60, prior to separation of the booster 65.

Although FIG. 12A illustrates a second booster assembly 60 protruding from the access port 184, this is merely for illustrative purposes, as in this embodiment the booster assembly 60 is sufficiently raised for the transfer arm 121 to engage the booster assembly 60 without any height adjustment from the transfer arm booster 118. In operational circumstances, a second booster assembly 60 would not be exposed from the bomb-proof box 111 until the first booster assembly 60 was located at the operative depth in the hole 90. Furthermore, the access hatch 112 in operation, would remain sealed when the ISV 101 is on the pit floor 91 to minimise exposure of the booster assemblies 60.

Within the booster crates 83, six individual booster assemblies 60 are housed. It is noted that the crates 83 may be formed to receive any other suitable number of boosters 60. The booster crates 83 are essentially comprised of six hollow storage tubes 17 held in configuration by an end plate 89*a*, a top plate 89*b*, and a mid-plate 89*c*. Each crate 83 further comprises a handle 87 for manually loading the crates 83 onto the carousel 135, see FIG. 15. Each of the plates 89*a*, 89*b*, 89*c* provide a guide 55 or mounting slot 53 with which to locate and secure the crate 83, whether that is within the carousel 135 or in a delivery vehicle 80.

The bomb-proof box 111 comprises an inner casing 111*a* within which the carousel 135, lifting assembly 50, and rotation mechanism 139 is housed. This is typically formed from steel and is sufficiently strong to contain an explosion with the box 111, illustrated in FIG. 13.

Within each of the storage tubes 17 of the crate 83 there is a guide 62 that holds the booster assembly 60 within the storage tube 17. The guide 62 in cross-section has an I-beam shape, having a central recess for receiving and supporting the stake 61 of the booster assembly 60 and an upper and lower flange that holds the guide 62 at a fixed location within the tube 17. The guide 62 is held in place by friction between the flanges of the guide and the inner walls of the tube 17.

As the carousel 135 rotates, three storage tubes 17 are brought into alignment with three lifters 59 of the lifting assembly 50. The carousel 135 comprises a plurality of through-holes 147 which are aligned with the storage tubes 17 of each crate 83. The alignment is facilitated by the mounting slots 53 and guides 55 of the booster crates 83 as loaded onto the carousel 135.

As the first of the three lifters 59 is activated, the lifter 59 extends through the cooperating through-hole 147 in the carousel 135 and extends further into the storage tube 17 above. The lifter 59 makes contact with the guide 62 and pushes the guide 62 (and booster assembly 60 therein) upwards along the tube 17, until the booster 65 is ejected from the box 111 through the access port 184. Once the lifter 59 reaches the extent of allowable travel, the lifter 59 is retracted back through the tube 17 and withdrawn from the cooperating hole 147 to allow the carousel 135 to rotate freely over the lifting assembly 50.

When the booster assembly 60 is withdrawn entirely from the storage tube 17, the guide 62 is retained by friction within the tube 17 and can be reused when the storage tubes 17 of each crate 83 are reloaded.

Figure 13:
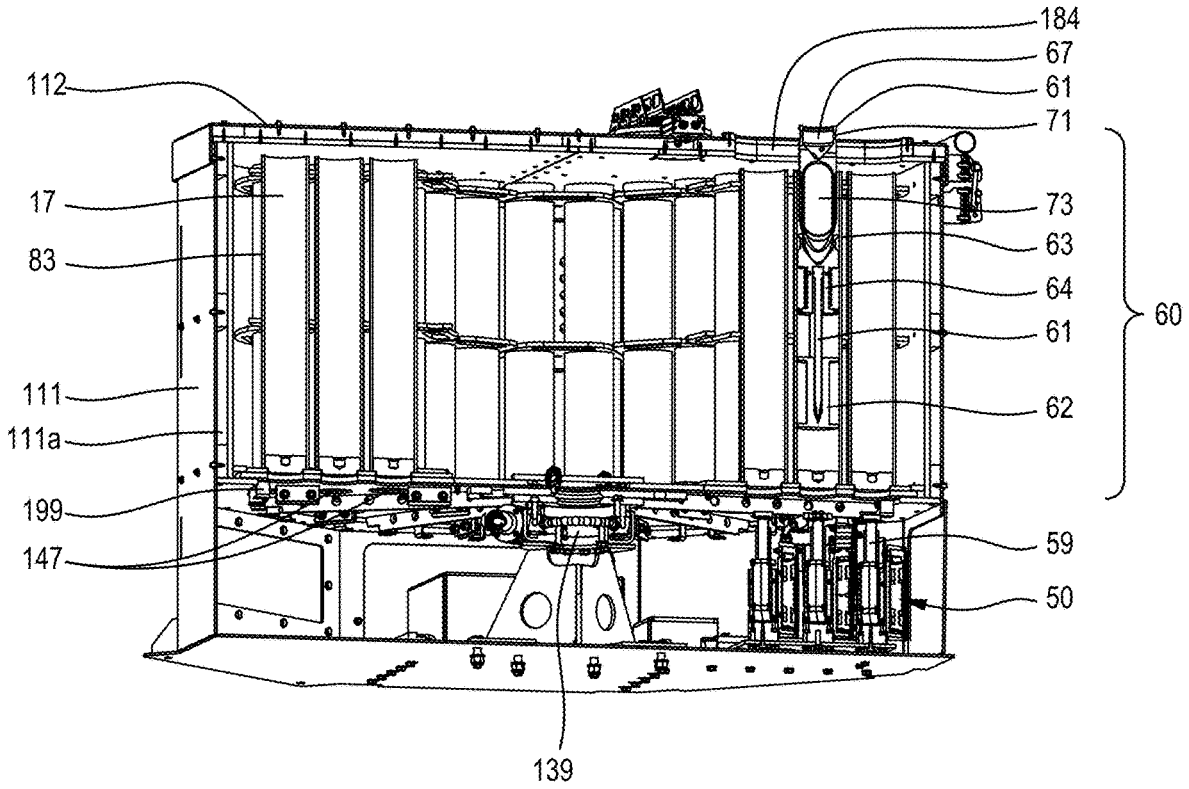
FIG. 13 is a perspective sectional view of the bomb-proof box of the vehicles shown in FIG. 7, illustrating a lifting assembly that ejects the booster assemblies from storage tubes within the portable booster crates.

The cross-sectional view of FIG. 13 illustrates a booster assembly 60 that has been partially ejected from the bomb-proof box 111. The cross-sectional view of the booster 65 illustrates the neck profile 71 for cooperating with the gripping means 123 and also a recess 67 forming a booster dock 69 for engaging with the booster engagement mechanism 49 of the pusher 41.

Figure 14A:
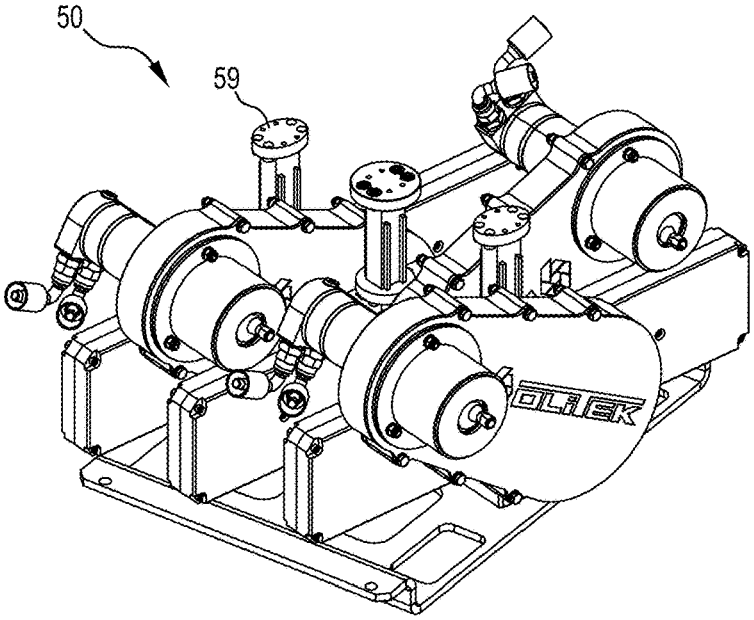
FIG. 14A is a perspective view of the lifting assembly shown in FIG. 13 in isolation from the bomb-proof box, configured to selectively eject a single booster assembly for a selected booster crate.
Figure 14B:
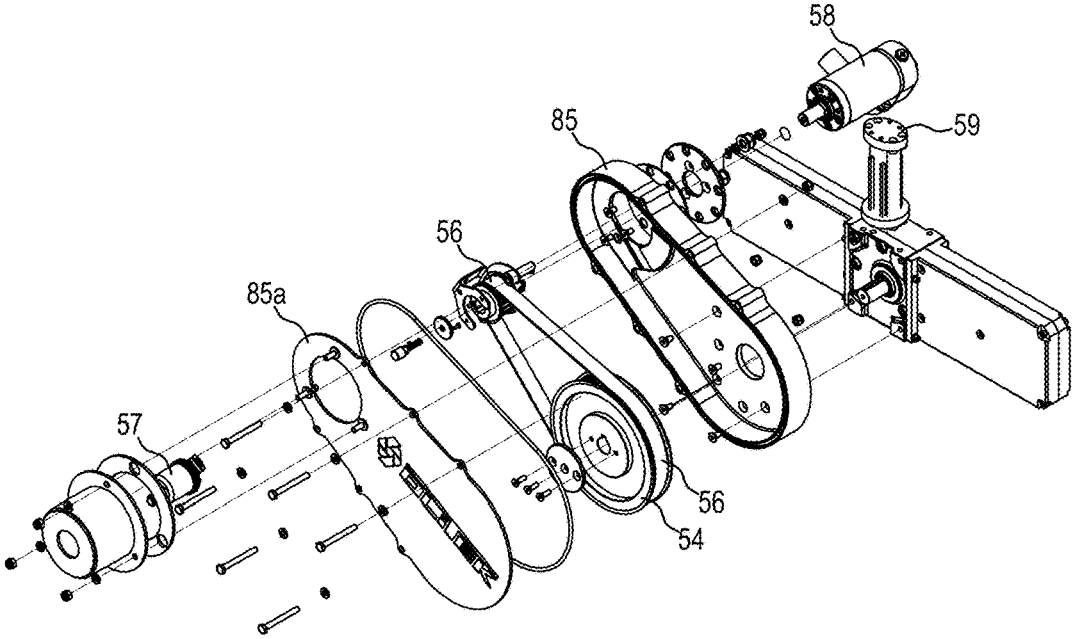
FIG. 14B is an exploded view of the lifting assembly of FIG. 14A, illustrating a motor and crank to operate the lifting assembly.
Figure 15:
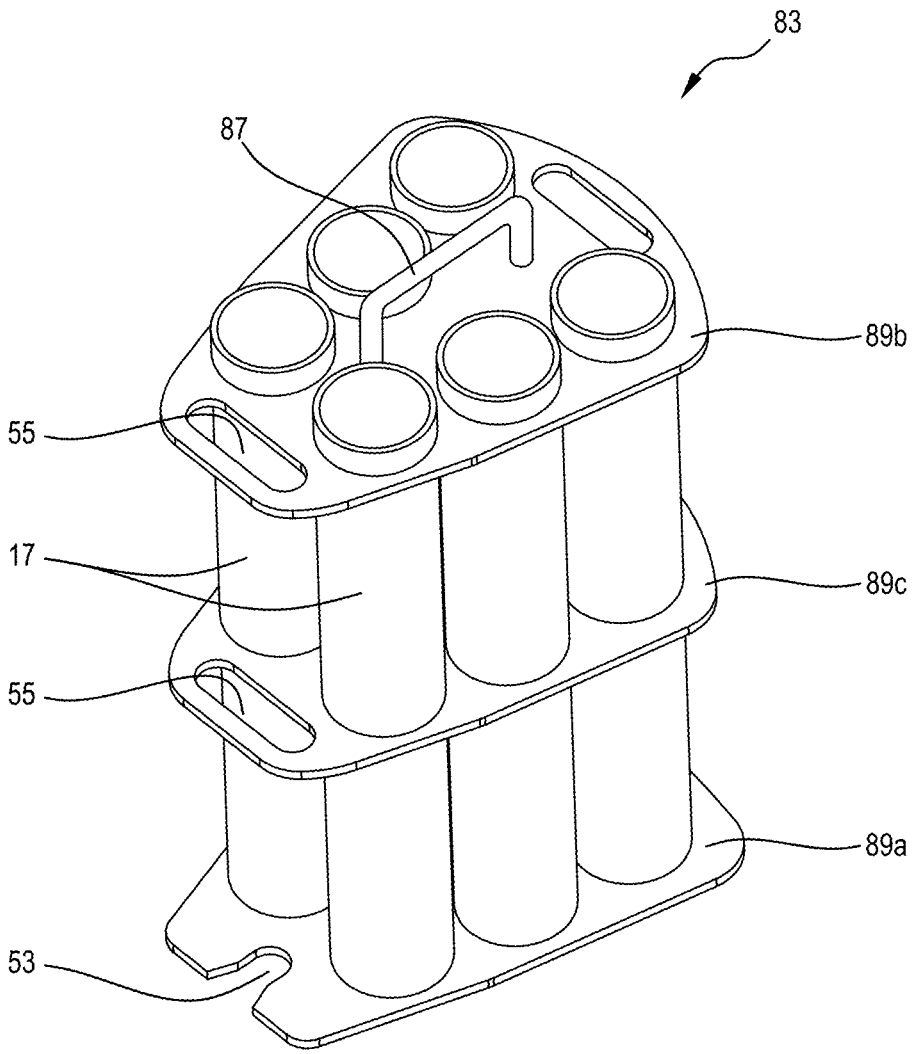
FIG. 15 is a perspective view of a portable booster crate and top mounted lifting handle of the vehicles shown in FIG. 7.
Figure 16:
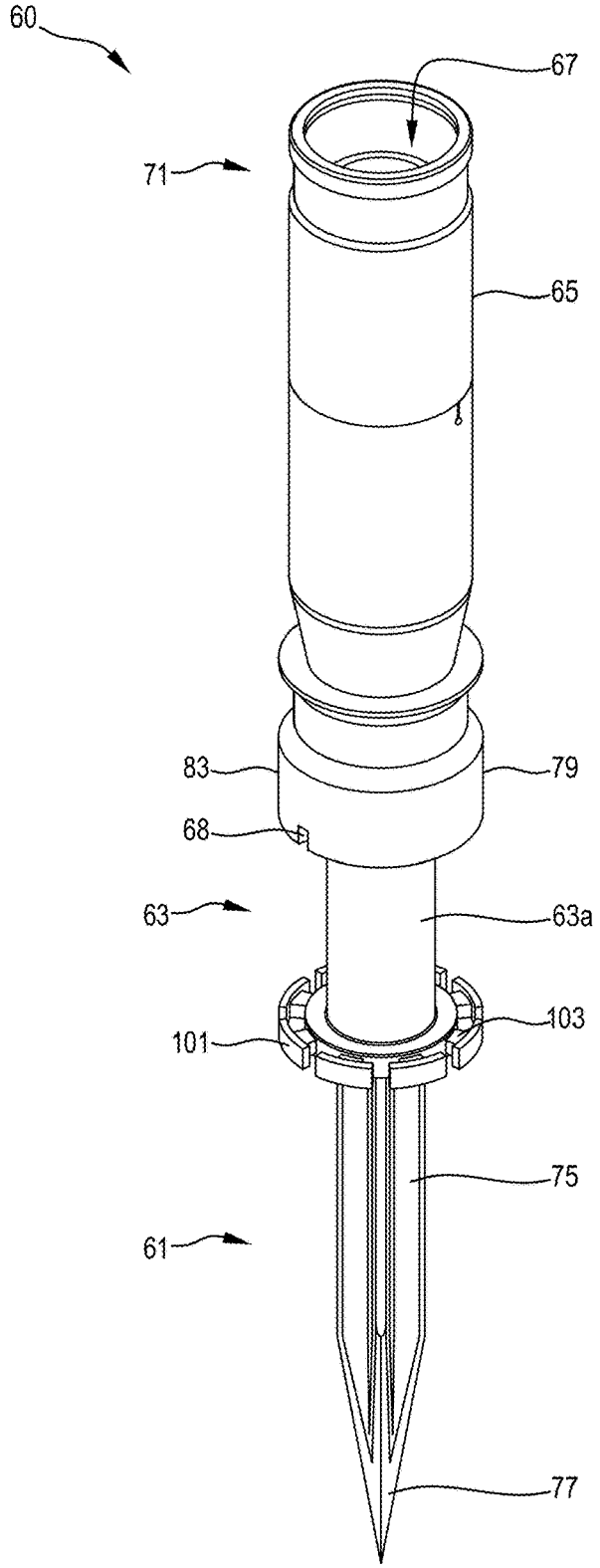
FIG. 16 is a perspective view of one embodiment of the booster assembly for use with the vehicles shown in FIGS. 1 and 7.
Figure 17:
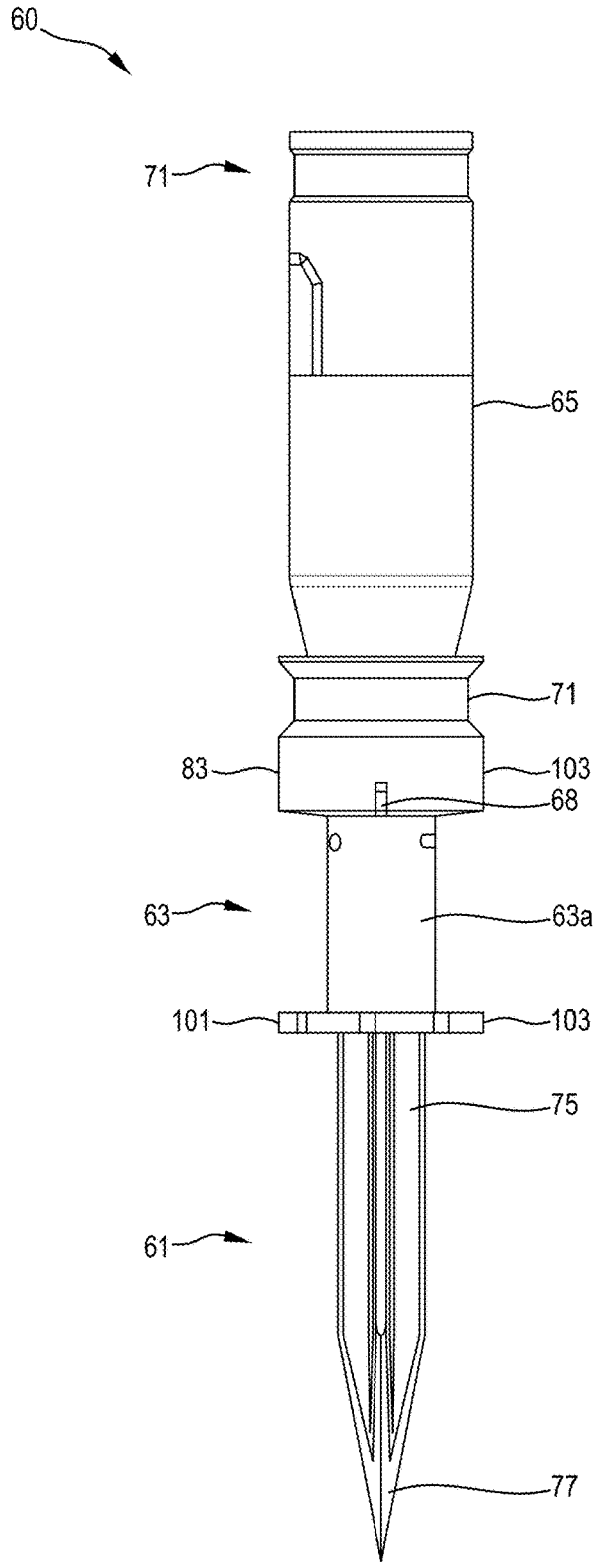
FIG. 17 is a side view of the booster assembly shown in FIG. 16.

The lifting assembly 50 is illustrated in FIGS. 14A and 14B to have three lifters 59. It is contemplated that additional lifters 59 could be added in a linear or non-linear configuration to support booster crates 83 carrying more than 6 booster assemblies 60.

With further reference to FIGS. 14A and 14B, the lifting assembly 50 comprises a hydraulic motor 58 that rotates three lifters 59 which are rotatably connected, similar to a vehicle crank mechanism. As the motor rotates, each lifter 59 individually reciprocates upwardly, then downwardly like a piston as the motor turns the crank. Each lifter 59 has a dedicated housing 85 containing a timing belt 56 wound around a pulley 54 and sealed with a housing cover 85*a*, to ensure that only one lifter 59 is activated at a time. Each timing belt and pulley also includes a rotary encoder 57 to monitor the stroke of the crank mechanism and relay a signal to an operator to monitor the progress of the booster assembly 60 being ejected from the storage tube 17 and out of the access port 184.

With reference to FIGS. 16 to 20, each of the booster 65, the spool 63, and the stake 61 of the embodiment of the booster assembly 60 shown in these Figures may be any suitable dimensions and made from any suitable materials.

The booster assembly 60 includes two axially-spaced apart collars 103 with outermost surfaces 101 having diameters that are selected to be marginally less than an inner diameter of the hollow storage tubes 17 so that the booster assembly 60 can be snugly stored in the tube and can slide in the tube.

Figure 18:
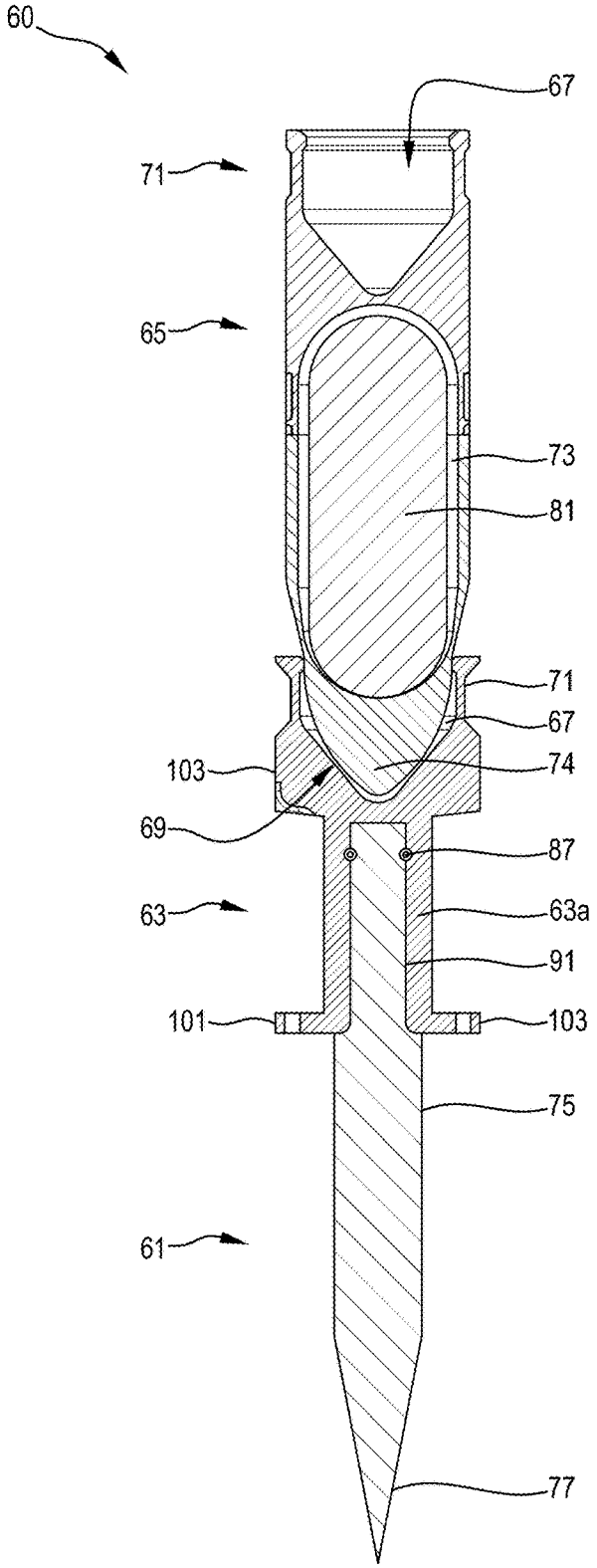
FIG. 18 is a vertical cross-section of the booster assembly shown in FIG. 17.
Figure 19:
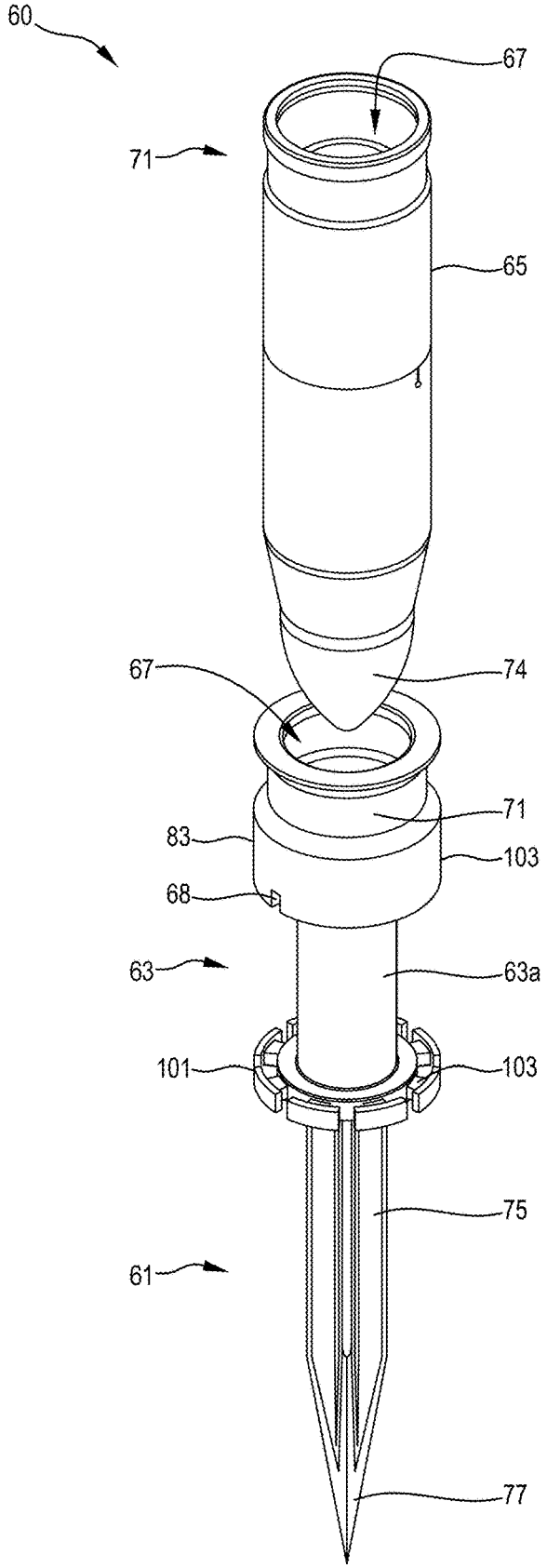
FIG. 19 is a perspective view of the booster assembly shown in FIG. 16, with the booster of the assembly lifted clear of the spool and the stake of the assembly.
Figure 20:
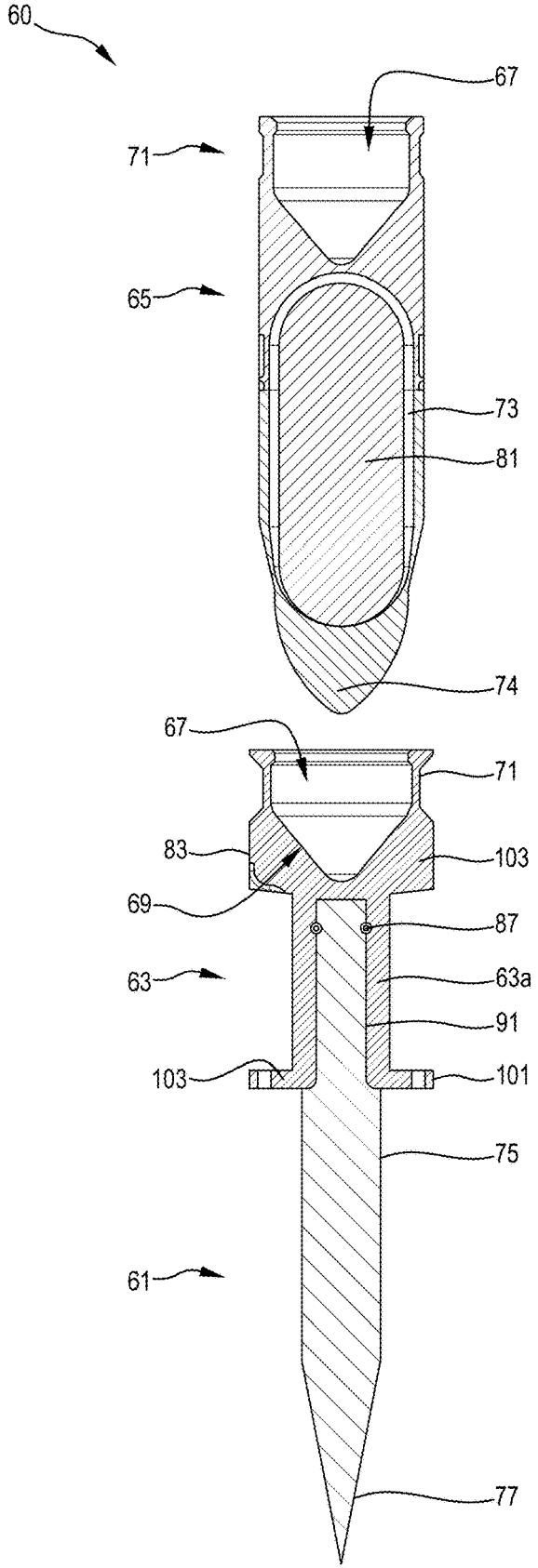
FIG. 20 is a vertical cross-section of the booster assembly shown in FIG. 19.

As can best be seen in FIGS. 18 and 20, the booster 65 contains a large internal cavity 73 for storing a liquid explosive 81, such as Powermite Thermo™ explosive.

A base 74 of the booster 65 is a bullnose shape that in use cooperates with an engagement recess 67 extending into the spool 63 from an upper end (as viewed in the Figures) and forms a booster dock 69 in the spool 63. The connection between the recess 67 of the spool 63 and the bullnose end 74 of the booster 65 is a push fit: tight enough to support and connect the spool 63 and the booster 65 but easily separated.

The spool 63 has a central neck 63 around which the detonation cord 66 (not shown in FIGS. 16 to 20) is wound for storage. A tie-off slot 68 (see FIGS. 16 and 19) is located on the spool 63 and is used to secure a free end (not shown) of the detonation cord 66.

As can best be seen in FIGS. 18 and 20, the spool 63 also includes a central cavity 91 extending axially into the spool 63 from a lower end of the spool 63 (as viewed in the Figures) that receives and locates an upper section of the stake 61.

The stake 61 has an elongate shank 75 and a pointed end 77 and is a robust structure for anchoring the spool 63 and attached detonation cord 66 to the pit floor 91 proximate a safe hole 90*a* in preparation for tie-in, as described above in relation to FIG. 2.

The stake 61 is connected to the spool 63 so that the spool 63 and the stake 61 are movable as a unit. The spool 63 and the stake 61 may be separately formed as two components that are connected together. The shank 75 of the stake 61 is received in the cavity 91 of the spool 63 and supported via bearings 87 so that the spool 63 can rotate about a central axis of the shank 75 and thereby, in use facilitate the detonation cord 66 unwinding from the spool 63 as the booster 65 is positioned in the hole 90 in the pit floor 91—see FIG. 2.

The head of the spool 63 and the head of the booster 65 have the same neck profile 71 so that the spool 63 and the boosters 65 can cooperate with the same gripping mechanism (not shown) of a delivery assembly of the above-mentioned ISV.

The spool 63 and the booster 65 have the same-shaped recess 67 to allow a pusher 41 of a delivery assembly of the above-mentioned ISV to separately engage with the spool 63 and the booster 65. The engagement of the pusher 41 and the booster 65 is illustrated in the embodiment of the booster assembly shown in FIGS. 8, 9, and 16-18.

Figure 21:
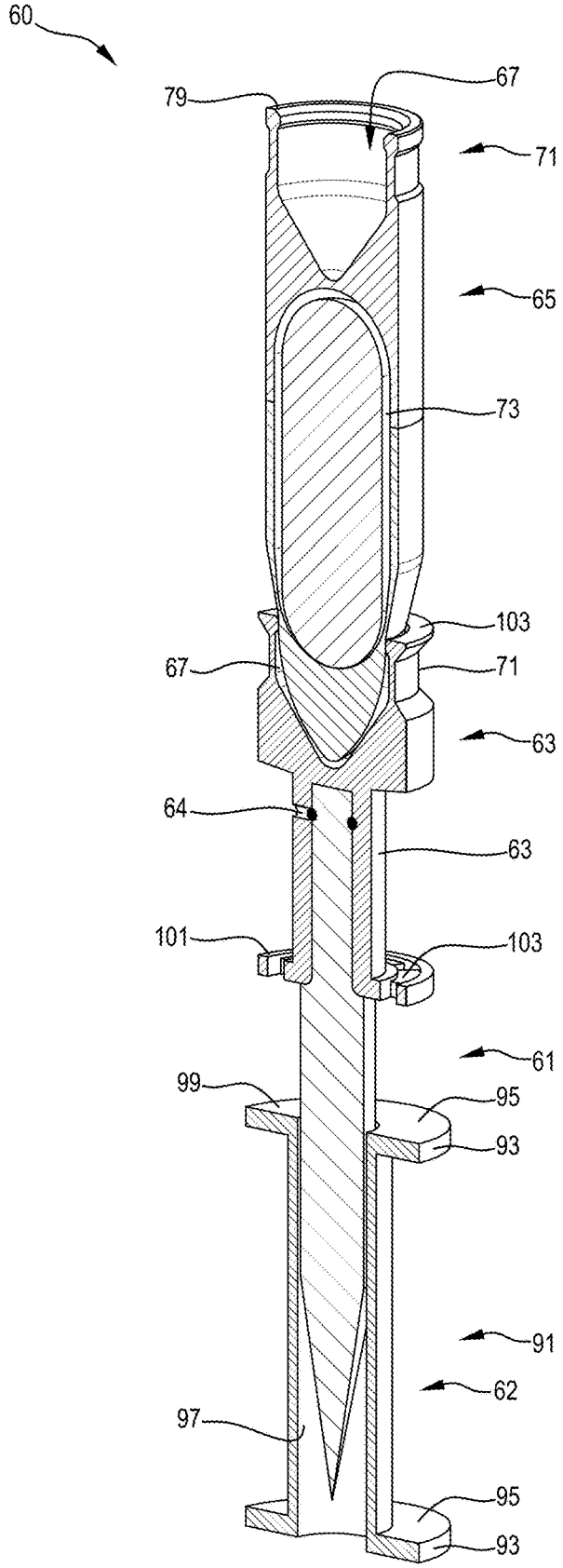
FIG. 21 is a perspective view of a second, although not the only other possible, embodiment of the booster assembly in an assembled configuration for use with the vehicles shown in FIGS. 1 and 7.

The embodiment of the booster assembly shown in FIG. 21 is very similar to the embodiment shown in FIGS. 16-20 and the same reference numerals are used to describe the same structural features.

The spool 63 and the stake 61 are identical to the same components in the embodiment shown in FIGS. 16-20.

However, the booster 65 is different. Specifically, the booster 65 is the same booster 65 as the booster 65 of the embodiment shown in FIGS. 22-27 and 30-32 described below.

FIG. 21 also shows an internal guide 62 of the ISV that, when the booster assembly 60 is stored within a hollow storage tube 17 of a storage crate 83, the guide 62 receives and supports a lower end of the stake 61 of the booster assembly 60 in the tube. The guide 62 includes outermost surfaces 113 that have a diameter that is marginally less than a diameter of an internal wall of the tube 17 and, in use, contacts the inner wall and facilitates sliding movement of the guide 62 in the tube 17. Specifically, the guide 62 includes a pair of spaced apart collars 95 that have the outermost surfaces 113. The spacing between the collars 95 is selected so that the guide 62 can move in a stable way within the tube 17. The guide 62 includes a cavity 97 extending downwardly (as viewed in the Figure) from an upper wall 99 of the guide for releasably receiving and supporting the stake 61. The shape of the cavity 97 corresponds to the shape of the lower end of the stake 61, as shown in the Figure, and the stake 61 is a snug fit in the cavity 97. With this arrangement, the stake 61 can be lifted clear of the guide 62 when the booster assembly 60 has been lifted to a raised position in the tube 17.

FIGS. 22-27 and 30-32 show details of another embodiment of a booster assembly 60.

Figure 27:
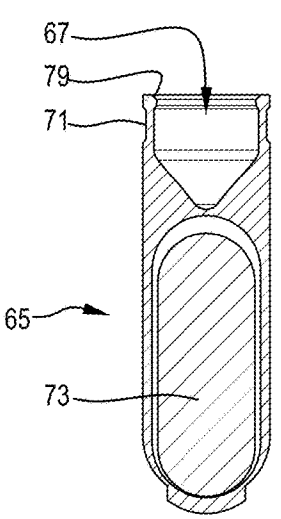
FIG. 27 is a sectional view of the booster of FIG. 26, illustrating the liquid explosive chamber therein.
Figure 26:
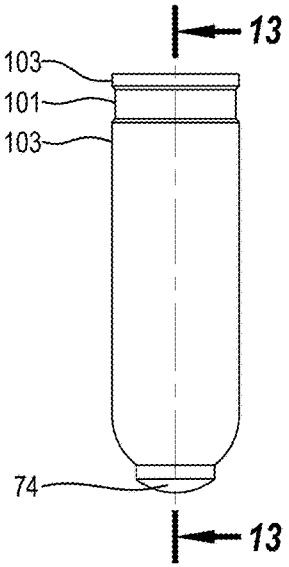
FIG. 26 is an enlarged side view of the booster shown in FIG. 22 housing a liquid explosive charge, illustrating an engagement recess for engaging with either of the pusher or the booster.
Figure 22:
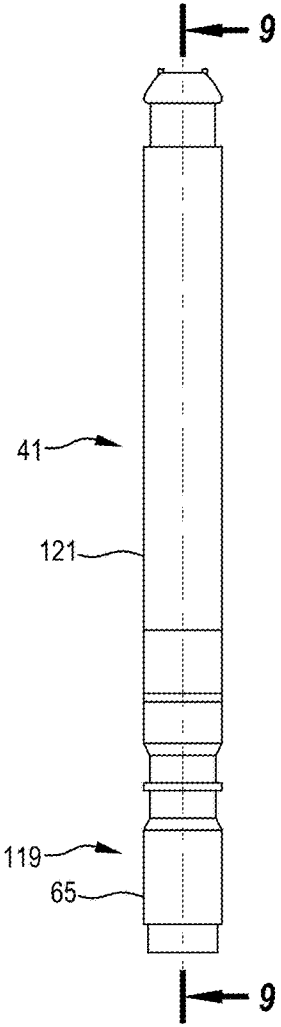
FIG. 22 is a side view of a booster of a third embodiment of a booster assembly for use with the vehicles shown in FIGS. 1 and 7 coupled to a pusher of a loading assembly illustrated in engagement with a head of the booster, with the other components of the booster assembly of this embodiment being shown in FIGS. 23-27.

The booster 65 of this booster assembly 60, as shown in FIGS. 22, 26 and 27, contains a large internal cavity 73 for storing a liquid explosive such as Powermite Thermo™ explosive.

Figure 29:
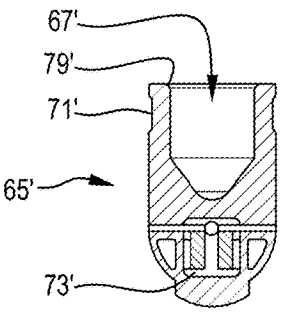
FIG. 29 is a sectional view of the booster of FIG. 28, illustrating the solid explosive chamber therein.
Figure 28:
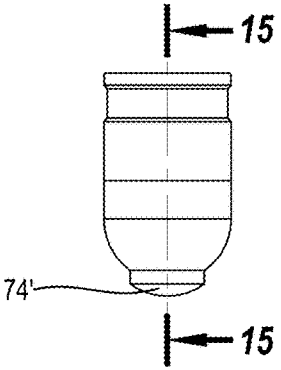
FIG. 28 is an enlarged side view of another, but not the only other, embodiment of a booster of a booster assembly for use with the vehicles shown in FIGS. 1 and 7 that can be used as a replacement for the boosters of the embodiments shown in FIGS. 16-27 to 32, with the booster housing a solid explosive charge, illustrating a head configured for cooperating with the transfer arm of the delivery assembly and with the engagement mechanism of the pusher.
Figure 30:
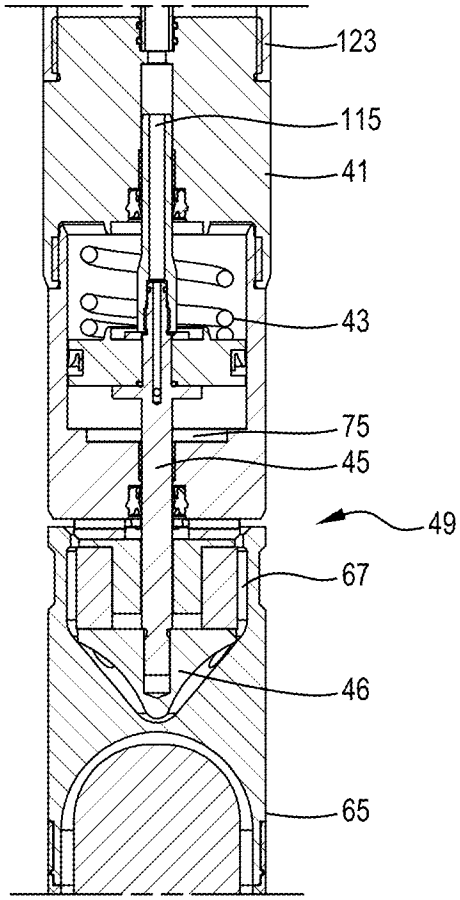
FIG. 30 is a sectional view of the pusher of the loading assembly of the vehicles shown in FIGS. 1 and 7 being inserted into the head of the booster shown in FIGS. 16-20 and 22-27 to locate the pusher in the booster, illustrating a compressible engagement member in a non-compressed state.

FIGS. 28 and 29 show another embodiment of a booster—identified by the numeral 65'—of the booster assembly shown in FIGS. 16-18 and 30-32.

The booster 65' shown in FIGS. 28 and 29 the cavity 73' is reduced in volume for storing a solid explosive such as an HMX explosive.

A base 74, 74' of both boosters 65, 65' provides a rounded protrusion that in use cooperates with the engagement recess 67 that forms a booster dock 69 in the spool 63. The connection between the recess 67 of the spool 63 and the base 74 of each booster 65, 65' is a push fit: tight enough to support and connect the spool 63 and each booster 65, 65' but easily separated.

The upper and lower portions of each booster 65, 65' are identical to facilitate engagement with a common design of the spool 63 and the pusher 41.

The spool 63 has a central neck 63*a* around which the detonation cord 66 is wound for storage. The tie-off slot 68 can be located anywhere upon the spool 63 and is used to secure a free end (not illustrated) of the detonation cord 66.

A brake mechanism 64 is provided within the spool 63 to limit the rate at which the detonation cord 66 is paid-out. The brake 64 comprises a pin that extends through the spool 63 and into contact with the stake 61 therein. Pushing or pulling on the pin increases or decreases the friction between the spool 63 and the stake 61 thereby altering the rate at which the spool 63 rotates about the stake 61.

The stake 61 of the booster assembly 60 is pointed and robust for anchoring the spool 63 and attached detonation cord 66 to the pit floor 91 adjacent to a safe hole 90*a* in preparation for tie-in.

The head of the spool 63 and the heads of the booster 65, 65' have the same neck profile 71 so that the spool 63 and each of the boosters 65, 65' can cooperate with the same gripping mechanism 123 of the delivery assembly 120.

Figure 25:
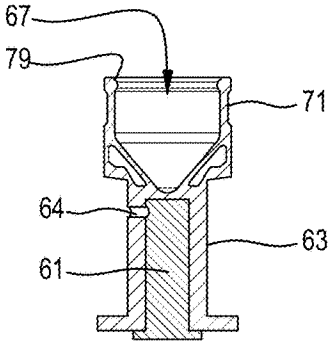
FIG. 25 is a sectional view of the spool from FIG. 24, illustrating the brake mechanism of the spool.
Figure 24:
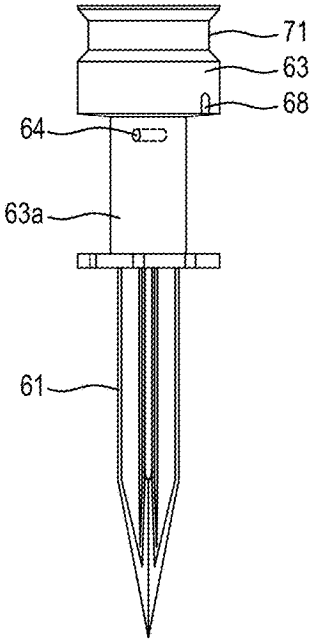
FIG. 24 is a side view of a stake and spool of the booster assembly shown in FIG. 22, illustrating the rotatable spool for storing the wound detonation cord thereabout, and a brake mechanism for controlling a release rate of the detonation cord from the spool.

The spool 63 and the booster 65, 65' have the same shaped recess 67' to allow the pusher 41 of the delivery assembly 30 to engage with the spool 63 and each of the boosters 65, 65'. The engagement of the pusher 4 and the booster 65 is illustrated in FIGS. 24 and 25.

FIGS. 26 and 27 illustrate the exterior neck profile 71 of the booster 65 for engagement with the gripping mechanism 123 of the delivery assembly 30. The neck profile comprises a base 101 extending around the perimeter of the booster 65 and two sides 103 extending from the base 101.

FIGS. 28 and 29 illustrate the exterior neck profile 71 of the booster 65' for engagement with the gripping mechanism 123 of the delivery assembly 30. The neck profile is similar to that shown in FIGS. 26 and 27.

FIGS. 27 and 29 illustrate an interior recess in the head of the booster 65, 65' forming a pusher dock 79, 79' for engagement with the pusher 41 of the loading assembly 30 of ISV 1 (equally applicable to ISV 101). The interior profile of the recess 67, 67' is shaped to correspond to the exterior profile of a conical nose 46 of the pusher 41 described further below in relation to FIGS. 30-32.

Figure 23:
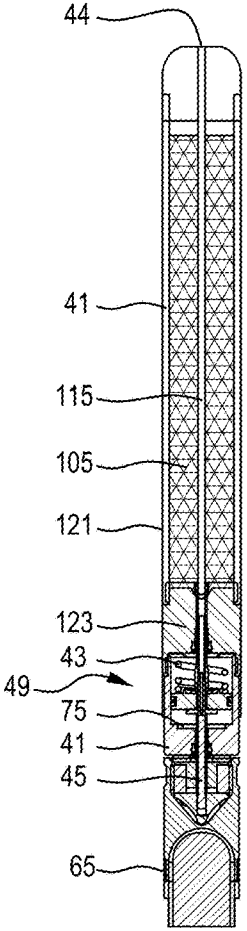
FIG. 23 is a sectional view of the pusher from FIG. 22, illustrating an engagement mechanism therein, for selectively engaging the booster head or a spool of the booster assembly.

The booster engagement mechanism of 49 of the pusher 41 of the delivery assembly of ISV 1 is illustrated in FIG. 23, with the booster 65 engaged to the pusher 41 in FIG. 31 and the booster 65 decoupled from the pusher 41 in FIG. 32. FIG. 30 shows the pusher 41 being inserted into the booster 65 as part of a process for coupling the booster 65 and the pusher 41 together.

The pusher 41 is an elongate element with an upper end and a lower end as evident from FIGS. 22 and 23 and a cylindrical side wall 121.

A large portion of the internal volume of the pusher 41 is filled with ballast 105 for example lead, to increase the weight of the pusher 41 and to assist the booster 65 move downwardly through the explosive emulsions 93 (FIG. 1).

The booster engagement mechanism 49 is located in a lower section of the pusher 41.

The pusher 41 includes a chamber 117 in a lower section of the pusher 41. The chamber 117 is defined by a section of the side wall 121 of the pusher 41, An upper partition member 123 that separates the chamber 117 and the ballast 105, and lower end element 125.

The pusher 41 also includes a plate 75 that is arranged for sliding movement along the length of the chamber 119. The plate 75 divides the chamber 117 into an upper chamber 117*a* and a lower chamber 117*b*.

The pusher 41 also includes a spring 43 in the upper chamber 117*a*. The spring 43 is selected so that it can extend axially downwardly and compress axially upwardly in response to sliding movement of the plate 75 in the chamber 117.

As can best be seen in FIG. 23, there is an air inlet 44 in an upper end of the pusher 41 and a central tube 115 for supplying air to the lower chamber 117*b* to allow the booster engagement mechanism 49 of the pusher 41 to be air activated, as shown in FIGS. 23 and 31. It is noted that reverse flow of air from the chamber 117 occurs when the air supply is cut-off.

The pusher 41 also includes a cylindrical actuator 45 that is connected at one end to the plate 75 and at the other end to the above-mentioned conical nose 46. The actuator 45 extends through an opening in the lower end element 125.

In addition, the pusher 41 includes a compressible member 48 that is mounted along a section of the length of the actuator 45 between the nose 46 and an end plate 75.

As can be appreciated from FIGS. 23 and 30-32, when the pusher 41 is inserted into the recess 67 of the pusher dock 79 of the booster 65, the booster 65 and the lower end element 125 of the pusher 41 form a closed chamber 127 which houses the compressible member 48. It can be appreciated from FIGS. 16-18 that the size of this chamber 127 can change.

Under normal operating conditions, it is necessary to supply air to the pusher 41 in order to couple together the booster 65 and the pusher 41. It is noted that when there is no air supply to the pusher 41, the pusher 41 will automatically decouple form the booster 65.

In use, in order to couple the pusher 41 to the booster 65, the pusher 41 and booster 65 are first axially aligned.

The conical nose 46 of the pusher 41 is then inserted into the recess 67 of the pusher dock 79 of the booster 65 until it cannot move forward from this engaged position—as shown in FIG. 30.

Compressed air is then fed into the inlet 44 and downwardly through the central tube 115 and into the lower chamber 117*b*. The air increases the pressure in the lower chamber 117*b* and causes the plate 75 to move upwardly in chamber 117 against the action of the spring 43. This upward movement of the plate 75 cause the actuator 45 and the nose 46 to move upwardly, thereby causing the compressible member 48 to be compressed in an axial direction and expanded outwardly in a radial direction. As the compressible member expands in a radial direction the friction between the recess 67 and the compressible member 48 is increased locking the pusher 41 to the booster 65, illustrated in the coupled mode of FIG. 31.

To decouple the pusher 41 from the booster 65, the compressed air source (not shown) is de-activated, and reduces the pressure in chamber 117*b*, at which time the return spring 43 expands, pushing plate 75 downwardly and the actuator 45 away from the pusher 41 and allowing the compressed member 48 to expand in an axial direction and contract in the radial direction, reducing the friction between the recess 67 and the compressible member 48 and releasing the booster 65 from the pusher 41, illustrated in the decoupled mode of FIG. 32.

Figure 33:
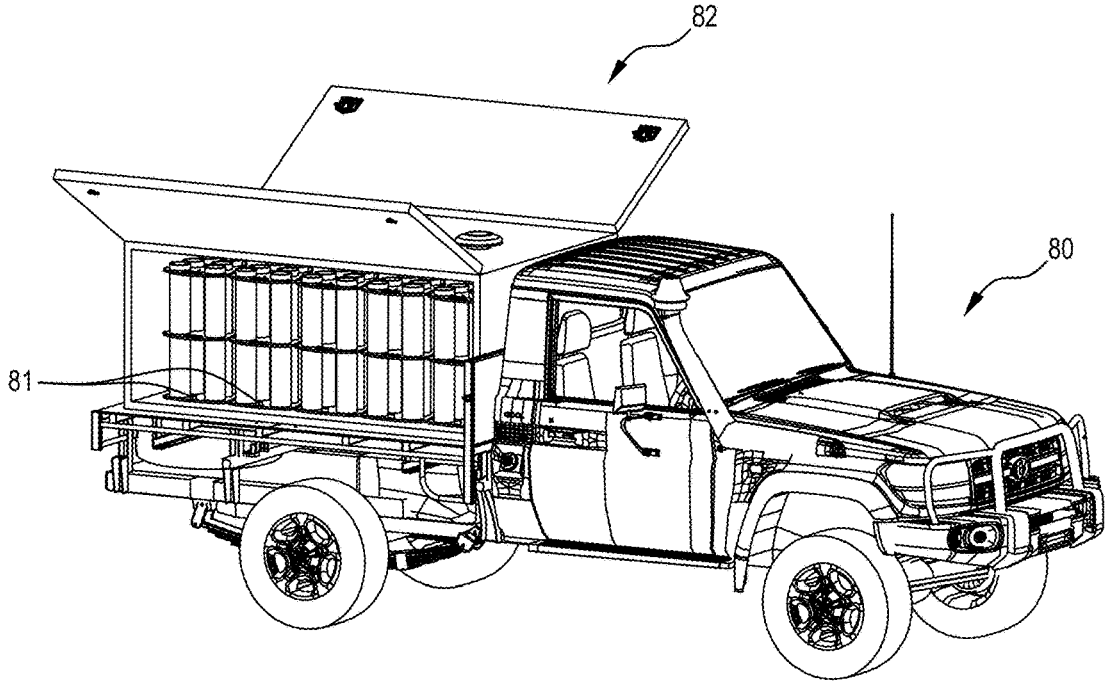
FIG. 33 is a perspective view of a booster crate delivery truck for delivering booster crates for the vehicles shown in FIGS. 1 and 7, illustrating a plurality of empty delivery tubes grouped into crates of 6.
Figure 34:
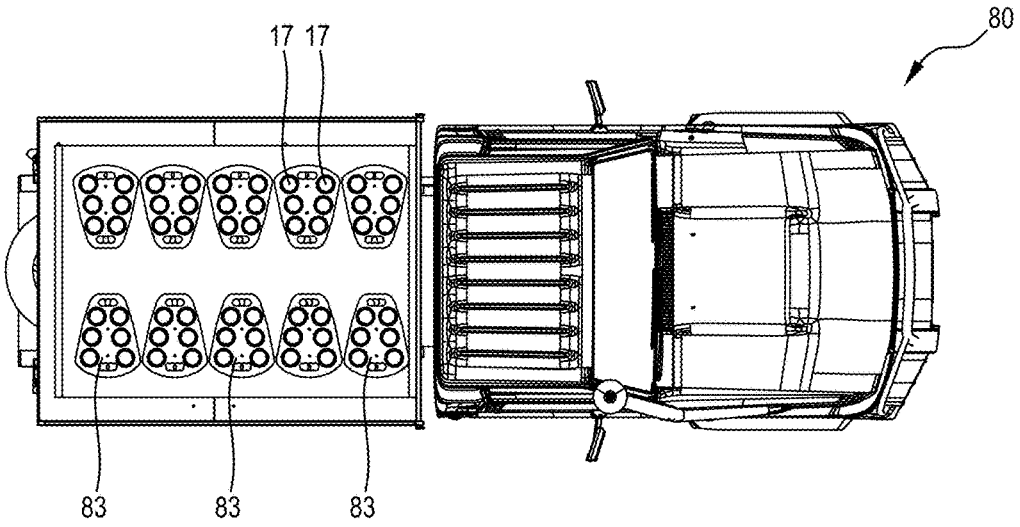
FIG. 34 is a top sectional view of the booster crate delivery truck shown in FIG. 33, illustrating the configuration of booster crates within the truck and the tie-downs for securing the loaded crates in transit.

A booster delivery vehicle 80 is illustrated in FIGS. 33 and 34. The vehicle 80 is configured to store a plurality of booster crates 83, empty or loaded with booster assemblies 60. The vehicle 80 provides a plurality of tie-down points 81 for securing the crates 83 to the bed of the vehicle 80 for transportation.

The booster crates 83 are entirely housed within a bombproof casing 82 which forms an enclosed cargo area of the vehicle 80. During transit the driver of the vehicle 80 and other road users are isolated from the loaded crates 82 within.

It will be appreciated by persons skilled in the art that numerous variations and modifications may be made to the above-described embodiments, without departing from the scope of the following claims. The present embodiments are, therefore, to be considered in all respects as illustrative of the scope of protection, and not restrictively.

By way of example, it is noted that the ISV 1, 101 may include load sensing, for example, a load cell on the base of the winch 108 to detect the tension in the cable 132 and hence delivery force of the booster 65. This can be used to sense the medium the booster 65 is being deployed into such as emulsion 93, water, mud, air etc. A force versus velocity map can be derived and stored in the controller of the ISV 1, 101, when deploying the booster 65 at different speeds the medium can be identified by comparing the force to the map derived and stored in the controller or another accessible means of data storage. This feature may also be applied to limit the force applied to the pusher 41 and hence the booster to avoid unsafe situations.

In addition, the embodiments of the ISV 1, 101 may include a control system 95 that is able to accept data such as a shot plan or call on data from a drill, emulsion loading device or other relevant surveying devices such as a temperature monitoring unit. The control system can receive this data by local upload/download, cloud server or other data transfer means. This data could be used for suitable product selection based on the data referenced to that drilled hole, depth of product insertion, location and/or identification of the hole. Data collected from the ISV 1, 101 may also be retrieved and/or uploaded to other systems and machines such as shot planning software and/or downstream processes such as stemming loaders to enhance the accuracy of automated mining processes.

In addition, whilst the embodiments of the ISV 1 are described in the context of delivering boosters 65, 65' containing an explosives charge to a blast hole, the invention is not so limited and extends to the use of other types of boosters that can initiate an explosion of an explosives material in a blast hole and do not rely on an explosives charge in the boosters.

Unless defined otherwise, all technical and scientific terms used herein have the same meaning as commonly understood by one of ordinary skill in the art to which this invention belongs. Although any methods and materials similar or equivalent to those described herein can also be used in the practice or testing of the present invention, a limited number of the exemplary methods and materials are described herein.

It is to be understood that, if any prior art publication is referred to herein, such reference does not constitute an admission that the publication forms a part of the common general knowledge in the art, in Australia or any other country.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

LEGEND

| No. | |
|---|---|
| 1 | IS Vehicle (ISV) |
| 2 | Wheeled chassis |
| 3 | Cabin |
| 4 | Mount arm |
| 5 | Support frame |
| 6 | Emergency-stop |
| 7 | Loading door |
| 8 | Winch |
| 9 | Bumper |
| 10 | Booster Storage Assembly |
| 11 | Bomb box |
| 12 | Access hatch |
| 13 | Gas strut |
| 14 | Manual op handle |
| 15 | Carousel drive |
| 16 | Hydraulic enclosure |
| 17 | Storage tube |
| 18 | Transfer arm booster |

-continued

| LEGEND | |
|---|---|
| No. | |
| 19 | Camera |
| 20 | Booster Delivery Assembly |
| 21 | Transfer arm |
| 22 | Detonation cord guide |
| 23 | Gripper jaws |
| 24 | Slew ring spacer |
| 25 | Hydraulic cylinder |
| 26 | Support post |
| 27 | Telescoping post |
| 28 | Mounting flange |
| 29 | Sensor |
| 30 | Booster Loading Assembly |
| 31 | Winch arm |
| 31a | Fairlead |
| 32 | Winch cable |
| 33 | Loading cage |
| 33a | Rods of cage |
| 34 | Detonation cord guide |
| 35 | Carousel (disc) |
| 36 | Actuated lid |
| 37 | Water tank |
| 38 | Water pump |
| 39 | Slew drive |
| 40 | |
| 41 | Pusher |
| 42 | Ballast |
| 43 | Return spring |
| 44 | Air inlet |
| 45 | Actuator |
| 46 | Nose |
| 47 | Co-operating apertures |
| 48 | Compressible member |
| 49 | Booster engagement mechanism |
| 50 | Booster Lifting Assembly |
| 51 | Hatch handle |
| 52 | Bomb box opening |
| 53 | Mounting slot |
| 54 | Pulley |
| 55 | Guides |
| 56 | Timing belt |
| 57 | Rotary encoder |
| 58 | Motor |
| 59 | Lifter |
| 60 | Booster Assembly |
| 61 | Stake |
| 62 | Guide |
| 63 | Spool |
| 63a | Neck of spool |
| 64 | Brake |
| 65 | Booster |
| 66 | Detonation cord |
| 67 | Engagement recess |
| 68 | Tie off slot |
| 69 | Booster dock |
| 70 | Prime mover |
| 71 | Clamping neck profile |
| 72 | Loading platform |
| 73 | Explosive cavity |
| 74 | Booster base |
| 75 | End plate |
| 76 | Solid Booster |
| 77 | Lights |
| 78 | Delivery tube |
| 79 | Pusher dock |
| 103 | collar |
| 101 | outermost surfaces of collar |
| 80 | Booster Delivery Vehicle |
| 81 | Crate tie down |
| 82 | Bomb proof casing |

-continued

| LEGEND | |
|---|---|
| No. | |
| 83 | Booster crate |
| 84 | Booster access port |
| 85 | Housing |
| 85a | Housing cover |
| 86 | Coupling |
| 87 | Crate handle |
| 88 | Holder |
| 89 | Crate plates |
| 90 | Drill hole |
| 90a | Safe hole |
| 91 | Pit floor |
| 92 | Aggregate |
| 93 | Explosive emulsion |
| 94 | Hole opening |
| 95 | Control System |
| 96 | Electrical enclosure |
| 97 | Pneumatic enclosure |
| 98 | Cage chute |
| 99 | RFID reader |

The invention claimed is:

1. An explosives delivery vehicle for delivering a booster for initiating an explosion of an explosives material in a hole in a floor of a pit to an operative depth in the hole, the vehicle comprising:

(a) a storage assembly for storing a plurality of boosters;

(b) a booster loading assembly for (i) supporting a booster of the plurality of boosters in a delivery position above the hole through the explosives material in the hole and (ii) moving the booster downwardly into the hole and inserting the booster at an operative depth in the hole, the booster loading assembly comprising a pusher element for applying a downwardly-acting force to move the booster into the hole through the explosives material to the operative depth; and (c) a delivery assembly for transporting the booster from the storage assembly to the loading assembly.

2. The explosives delivery vehicle of claim 1, wherein the downwardly-acting force is a gravitational force pulling the booster into the hole to the operative depth.

3. The explosives delivery vehicle of claim 1, wherein the booster and the pusher element have complementary formations that allow the booster to receive and locate the pusher element.

4. The explosives delivery vehicle of claim 3, wherein the booster and the pusher element have complementary formations that allow the pusher element to be positively docked with the booster.

5. The explosives delivery vehicle of claim 1, wherein the pusher element is formed to (a) couple the booster and the pusher element together to support the booster while the pusher element, in use, moves the booster downwardly into the hole to the operative depth in the hole and (b) release the booster from the pusher element when the booster is at the operative depth so that the pusher element can be withdrawn from the hole.

6. The explosives delivery vehicle of claim 1, wherein the delivery assembly comprises an arm that is moveable to transport the booster from the storage assembly to the loading assembly.

7. The explosives delivery vehicle of claim 1, wherein the booster is part of a booster assembly, with the booster assembly comprising in co-axial alignment:

(a) the booster;

(b) a spool and a detonation cord wrapped around the spool in a storage position outside the hole and connected to the spool and to the booster, with the spool being provided for allowing the detonation cord to be unwound from the spool as the booster is moved from the storage position to the operative depth in the hole and the spool remains in the storage position; and (c) a stake for locating the spool in the pit floor proximate the hole after the booster is at the operative depth in the hole; and with an end of the spool being formed to receive and locate an end of the booster such that the booster is seated on the spool when the booster assembly is in an upright orientation in the storage position before moving the booster to the operative depth in the hole.

8. The explosives delivery vehicle of claim 7, wherein the booster and the spool have complementary formations that allow the spool to receive and locate the booster.

9. The explosives delivery vehicle of claim 7, wherein the booster and the spool have complementary formations that allow the booster to be positively docked on the spool.

10. The explosives delivery vehicle of claim 7, wherein the storage assembly is adapted to store a plurality of the booster assemblies.

11. The explosives delivery vehicle of claim 7, wherein the booster comprises a booster casing that contains the explosives charge.

12. The explosives delivery vehicle of claim 11, wherein the booster casing has an engagement feature that facilitates engagement of the booster with an arm of the delivery assembly that is moveable to transport the booster from the storage assembly to the loading assembly.

13. The explosives delivery vehicle of claim 7, wherein the spool has a brake to control releasing of the detonation cord.

14. The explosives delivery vehicle of claim 7, wherein the storage assembly comprises a plurality of upwardly-extending storage tubes for receiving and retaining the booster or the booster loading assembly, with one booster or booster loading assembly per storage tube; and wherein the storage assembly comprises a platform that is arranged to rotate about a central upright axis, with the platform supporting the storage tubes.

15. A booster assembly for use in a drill and blast operation, with the booster assembly comprising in co-axial alignment:

(a) a booster for initiating an explosion of an explosives material in a hole in a floor of a pit;

(b) a spool and a detonation cord wrapped around the spool in a storage position outside the hole and connected to the spool and to the booster, with the spool being provided for allowing the detonation cord to be unwound from the spool as the booster is moved from the storage position to the operative depth in the hole and the spool remains in the storage position; and (c) a stake for locating the spool in the pit floor proximate the hole after the booster is in the operative depth in the hole; and with an end of the spool being formed to receive and locate an end of the booster such that the booster is seated on the spool when the booster assembly is in an upright orientation in the storage position before moving the booster to the operative depth in the hole.

16. A method of delivering a booster for initiating an explosion of an explosive material in a hole in a floor of a pit into the hole, the method comprising the following steps controlled by an operator in a cabin of the vehicle or at a remote location to the vehicle or controlled as part of autonomous operation:

(a) positioning a booster delivery vehicle in a pit proximate the hole;

(b) removing a booster from a storage unit of the vehicle and moving the booster to a delivery position above the hole; and (c) operating a loading assembly and moving the booster downwardly from the delivery position and inserting the booster through the explosives material in the hole to an operative depth in the hole.

17. The method of claim 16, wherein the booster is part of a booster assembly, with the booster assembly comprising in axial alignment:

the booster, a spool and a detonation cord wrapped around the spool and connected at one end to the spool and at the other end to the booster, with the spool being provided for allowing the detonation cord to be unwound from the spool as the booster is moved from a storage position outside the hole to the operative depth in the hole and the spool remains in the storage position, and a stake for locating the spool in the pit floor proximate the hole after the booster is in the operative depth in the hole, and wherein step (b) comprises removing the booster assembly from the storage unit and moving the booster assembly to an intermediate delivery position and then moving the booster of the booster assembly to the delivery position above the hole.

18. The method of claim 17, further comprising retaining the spool, the detonation cord, and the stake of the booster assembly at the intermediate position when the booster is moved to the delivery position.

19. The method of claim 16, wherein step (c) comprises:

(i) coupling together the booster and a pusher element that forms part of the loading assembly and is adapted to apply a downwardly-acting force to the booster, (ii) while coupled together, allowing the pusher element to move the booster and the pusher element downwardly from the delivery position to the operative depth of the booster in the hole, and (iii) releasing the booster from the pusher element when the booster is at the operative depth and withdrawing the pusher element from the hole.

20. An explosives delivery vehicle for delivering a booster for initiating an explosion of an explosives material in a hole in a floor of a pit to an operative depth in the hole, the vehicle comprising:

(a) a storage assembly for storing a plurality of boosters;

(b) a booster loading assembly for (i) supporting a booster of the plurality of boosters in a delivery position above the hole and (ii) moving the booster downwardly into the hole and inserting the booster at an operative depth in the hole; and (c) a delivery assembly for transporting the booster from the storage assembly to the loading assembly, wherein:

the booster is part of a booster assembly, the booster assembly comprising, in co-axial alignment:

(i) the booster;

(ii) a spool and a detonation cord wrapped around the spool in a storage position outside the hole and connected to the spool and to the booster, with the spool being provided for allowing the detonation cord to be unwound from the spool as the booster is moved from the storage position to the operative depth in the hole and the spool remains in the storage position; and (iii) a stake for locating the spool in the pit floor proximate the hole after the booster is at the operative depth in the hole; and an end of the spool is formed to receive and locate an end of the booster such that the booster is seated on the spool when the booster assembly is in an upright orientation in the storage position before moving the booster to the operative depth in the hole.

* * * * *